US011521560B2

(12) United States Patent
Bae et al.

(10) Patent No.: US 11,521,560 B2
(45) Date of Patent: Dec. 6, 2022

(54) ELECTRONIC DEVICE FOR CONTROLLING VOLTAGE SLEW RATE OF SOURCE DRIVER ON BASIS OF LUMINANCE

(71) Applicant: SAMSUNG ELECTRONICS CO., LTD., Suwon-si (KR)

(72) Inventors: Jongkon Bae, Suwon-si (KR); Yunpyo Hong, Suwon-si (KR); Yohan Lee, Suwon-si (KR); Donghwy Kim, Suwon-si (KR); Dongkyoon Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/262,548

(22) PCT Filed: Jun. 4, 2019

(86) PCT No.: PCT/KR2019/006686
§ 371 (c)(1),
(2) Date: Jan. 22, 2021

(87) PCT Pub. No.: WO2020/032368
PCT Pub. Date: Feb. 13, 2020

(65) Prior Publication Data

US 2021/0295782 A1 Sep. 23, 2021

(30) Foreign Application Priority Data

Aug. 9, 2018 (KR) ..... 10-2018-0092910

(51) Int. Cl.
*G09G 3/3283* (2016.01)

(52) U.S. Cl.
CPC ..... *G09G 3/3283* (2013.01); *G09G 2310/066* (2013.01); *G09G 2320/0653* (2013.01);
(Continued)

(58) Field of Classification Search
CPC ..... G09G 3/3283; G09G 2330/023; G09G 2320/0673; G09G 2320/0653; G09G 2310/066
See application file for complete search history.

(56) References Cited

U.S. PATENT DOCUMENTS 7,321,352 B2 1/2008 Lee et al.
7,339,569 B2 3/2008 Moon et al.
(Continued)

FOREIGN PATENT DOCUMENTS

KR 10-0767364 10/2007
KR 10-0777705 11/2007
(Continued)

OTHER PUBLICATIONS

International Search Report for PCT/KR2019/006686 dated Sep. 16, 2019, 5 pages.
(Continued)

*Primary Examiner* — Alexander Eisen
*Assistant Examiner* — Kebede T Teshome
(74) *Attorney, Agent, or Firm* — Nixon & Vanderhye, P.C.

(57) ABSTRACT

Disclosed is an electronic device including a display panel displaying an image, a source driver supplying a source voltage to the display panel, and a display driver integrated circuit (DDI) including a timing controller controlling the source driver. The timing controller may be configured to identify information associated with a luminance of the image and to set a source bias current for controlling a slew rate of the source voltage based on the luminance of the image. Besides, various embodiments as understood from the specification are also possible.

15 Claims, 16 Drawing Sheets

(52) U.S. Cl.
CPC ..... *G09G 2320/0673* (2013.01); *G09G 2330/023* (2013.01)

(56) References Cited

U.S. PATENT DOCUMENTS

| | | | | |
|---|---|---|---|---|
| 8,031,148 | B2 | 10/2011 | Moon et al. | |
| 8,115,755 | B2 | 2/2012 | Chia | |
| 8,416,177 | B2 | 4/2013 | Park et al. | |
| 9,275,595 | B2 | 3/2016 | Kim et al. | |
| 9,311,856 | B2 | 4/2016 | Park et al. | |
| 9,721,511 | B2 | 8/2017 | Jeong et al. | |
| 9,984,639 | B2 | 5/2018 | Yin et al. | |
| 10,147,381 | B2 | 12/2018 | Lee et al. | |
| 10,535,301 | B2 | 1/2020 | Chae et al. | |
| 10,607,563 | B2 | 3/2020 | Kim et al. | |
| 2007/0139350 | A1* | 6/2007 | Kawaguchi | G09G 5/10 345/100 |
| 2008/0211792 | A1 | 9/2008 | Lee et al. | |
| 2010/0060674 | A1* | 3/2010 | Yoshida | H05B 45/12 315/149 |
| 2013/0307838 | A1 | 11/2013 | Kim et al. | |
| 2014/0253534 | A1 | 9/2014 | Kim et al. | |
| 2015/0103105 | A1 | 4/2015 | Kim et al. | |
| 2015/0130851 | A1* | 5/2015 | Jeong | G09G 3/20 345/690 |
| 2016/0078841 | A1 | 3/2016 | Park et al. | |
| 2016/0093270 | A1 | 3/2016 | Lee et al. | |
| 2016/0098959 | A1 | 4/2016 | Moon et al. | |
| 2017/0004799 | A1 | 1/2017 | Park et al. | |
| 2017/0345383 | A1 | 11/2017 | Yin et al. | |

FOREIGN PATENT DOCUMENTS

| | | |
|---|---|---|
| KR | 10-2009-0068342 | 6/2009 |
| KR | 10-1073569 | 10/2011 |
| KR | 10-2012-0120517 | 11/2012 |
| KR | 10-2013-0128933 | 11/2013 |
| KR | 10-2014-0109135 | 9/2014 |
| KR | 10-2015-0055253 | 5/2015 |
| KR | 10-2017-0005291 | 1/2017 |
| KR | 10-2017-0124150 | 11/2017 |
| KR | 10-2018-0023090 | 3/2018 |
| KR | 10-1839953 | 3/2018 |
| KR | 10-2018-0066313 | 6/2018 |

OTHER PUBLICATIONS

Written Opinion of the ISA for PCT/KR2019/006686 dated Sep. 16, 2019, 6 pages.
Communication pursuant to Rule 164(1) EPC dated Sep. 3, 2021 in counterpart European Application No. 19847410.8.
Extended Search Report dated Jan. 17, 2022 in EP Application No. 19847410.8.

* cited by examiner

ELECTRONIC DEVICE FOR CONTROLLING VOLTAGE SLEW RATE OF SOURCE DRIVER ON BASIS OF LUMINANCE

This application is the U.S. national phase of International Application No. PCT/KR2019/006686 filed Jun. 4, 2019 which designated the U.S. and claims priority to KR Patent Application No. 10-2018-0092910 filed Aug. 9, 2018, the entire contents of each of which are hereby incorporated by reference.

FIELD

Embodiments disclosed in the disclosure relate to a technology that controls a source bias current for setting a slew rate of a source voltage for driving a display.

DESCRIPTION OF RELATED ART

An electronic device (e.g., a smart phone or a wearable device) may include a display that displays an image. The display includes a display panel, a display driver integrated circuit (DDI) that drives the display panel, and a source driver that supplies a source voltage to the display panel.

The source driver adjusts a gray level, which is the grayscale of an image displayed by the display panel, by adjusting a level of the source voltage. The change amount and change rate of the source voltage according to an increase of the gray level may vary depending on the luminance of the image. The slew rate of the source voltage, which is the change rate of the source voltage, is set depending on the magnitude of the source bias current supplied to an amplifier circuit of the source driver.

SUMMARY

A conventional electronic device may increase the magnitude of a source bias current by using an amplifier circuit of a source driver. Furthermore, the conventional electronic device may increase the slew rate of a source voltage by instantaneously increasing the source bias current in a section, in which the source voltage is changed, using a boosting circuit connected to the amplifier circuit of the source driver. However, when a boosting circuit is always used, the power consumed by the source driver increases.

Also, the conventional electronic device has a uniform slew rate regardless of the level of the source voltage. In the case where the slew rate of the source voltage is uniform, the time required until the source voltage is output when the change amount of the source voltage is changed may be changed depending on a luminance. The change amount of the source voltage depends on the luminance, and thus the time required until the source voltage is output is changed depending on the luminance.

Embodiments disclosed in this specification are intended to provide the electronic device for solving the above-described problem and problems brought up in this specification.

According to an embodiment disclosed in this specification, an electronic device may include a display panel displaying an image, a source driver supplying a source voltage to the display panel, and a display driver integrated circuit (DDI) including a timing controller controlling the source driver. The timing controller may be configured to identify information associated with a luminance of the image and to set a source bias current for controlling a slew rate of the source voltage based on the luminance of the image.

Furthermore, according to an embodiment disclosed in this specification, an electronic device may include a display panel including one or more pixels, a source port electrically connected to at least part of the one or more pixels, and a DDI including a source amplifier electrically connected the source port. The DDI may be configured to identify a luminance set for the display panel, to drive the source amplifier such that a slew rate of a voltage output through the source amplifier has a first slope, when the luminance belongs to a first specified range, and to drive the source amplifier such that the slew rate of the voltage output through the source amplifier has a second slope lower than the first slope when the luminance belongs to a second specified range lower than the first specified range.

Moreover, according to an embodiment disclosed in this specification, an electronic device may include a display panel including one or more pixels, a source port electrically connected to at least part of the one or more pixels, and a DDI including a source amplifier electrically connected the source port. The DDI may be configured to identify a luminance set for the display panel, to drive the source amplifier at a first drive strength such that a slew rate of a voltage output through the source amplifier has a first slope when the luminance belongs to a first specified range, and to drive the source amplifier at a second drive strength lower than the first drive strength such that the slew rate of the voltage output through the source amplifier has a second slope lower than the first slope when the luminance belongs to a second specified range lower than the first specified range.

According to embodiments disclosed in this specification, an electronic device may reduce power consumed by a source driver.

Furthermore, according to embodiments disclosed in this specification, the electronic device may control a slew rate of the source voltage in real time depending on the luminance of an image displayed on a display panel.

Besides, a variety of effects directly or indirectly understood through the specification may be provided.

With regard to description of drawings, the same similar components will be marked by the same or similar reference signs.

DETAILED DESCRIPTION OF EXAMPLE EMBODIMENTS

Hereinafter, various embodiments of the disclosure will be described with reference to accompanying drawings. Ho ever, it should be understood that this is not intended to limit the disclosure to specific implementation forms and includes various modifications, equivalents, and/or alternatives of embodiments of the disclosure.

Figure 1:
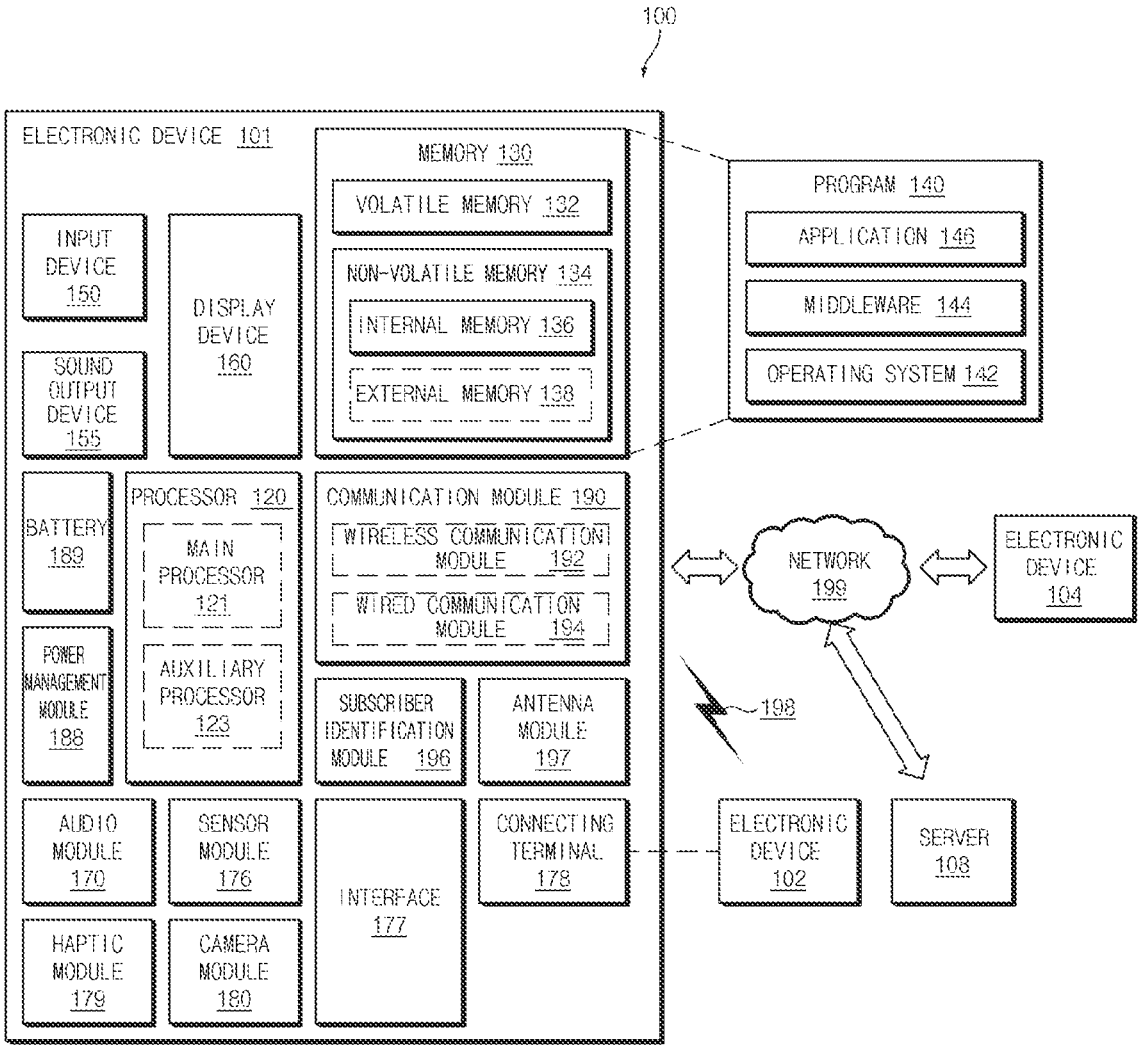
FIG. 1 is a block diagram illustrating an electronic device in a network environment, controlling a slew rate of a slew rate of a voltage of a source driver based on an illuminance, according to various embodiments.

FIG. 1 is a block diagram illustrating an electronic device 101 in a network environment 100, controlling a slew rate of a slew rate of a voltage of a source driver based on an illuminance, according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
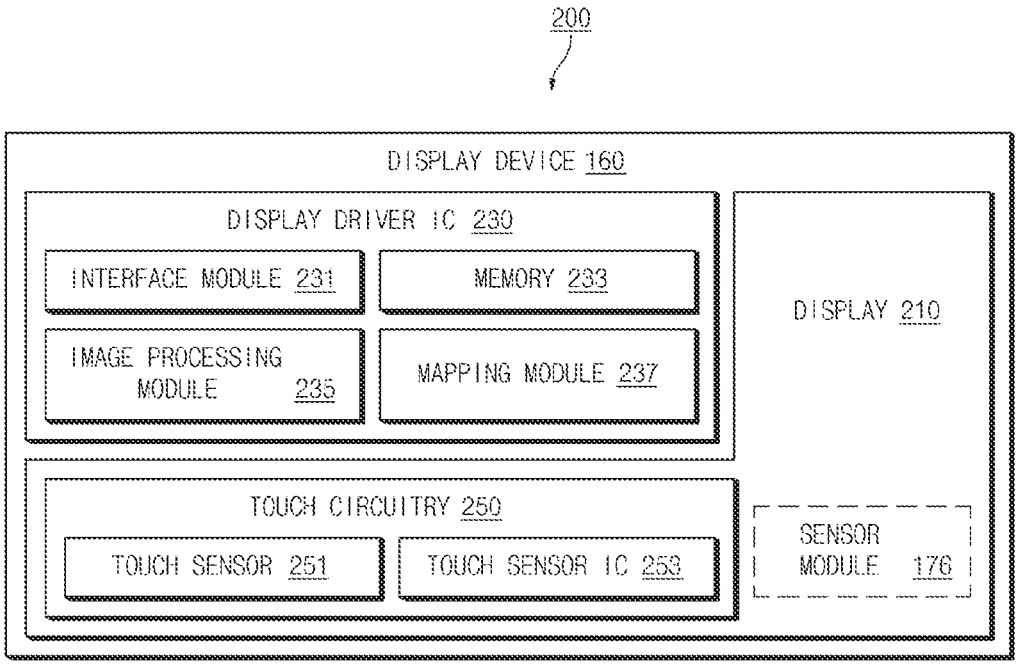
FIG. 2 is a block diagram illustrating the display device, controlling a slew rate of a slew rate of a voltage of a source driver based on an illuminance, according to various embodiments.

FIG. 2 is a block diagram 200 illustrating the display device 160, controlling a slew rate of a slew rate of a voltage of a source driver based on an illuminance, according to various embodiments. Referring to FIG. 2, the display device 160 may include a display 210 and a display driver integrated circuit (DDI) 230 to control the display 210. The DDI 230 may include an interface module 231, memory 233 (e.g., buffer memory), an image processing module 215 or a mapping module 237. The DDI 230 may receive image information that contains image data or an image control signal corresponding to a command to control the image data from another component of the electronic device 101 via the interface module 231. For example, according to an embodiment, the image information may be received from the processor 120 (e.g., the main processor 121 (e.g., an application processor)) or the auxiliary processor 123 (e.g., a graphics processing unit) operated independently from the function of the main processor 121. The DDI 230 may communicate, for example, with touch circuitry 150 or the sensor module 176 via the interface module 231. The DDI 230 may also store at least part of the received image information in the memory 233, for example, on a frame by frame basis. The image processing module 235 may perform pre-processing or post-processing (e.g., adjustment of resolution, brightness, or size) with respect to at least part of the image data. According to an embodiment, the pre-processing or post-processing may be performed, for example, based at least in part on one or more characteristics of the image data or one or more characteristics of the display 210. The mapping module 237 may generate a voltage value or a current value corresponding to the image data pre-processed or post-processed by the image processing module 235. According to an embodiment, the generating of the voltage value or current value may be performed, for example, based at least in part on one or more attributes of the pixels (e.g., an array, such as an RGB stripe or a pentile structure, of the pixels, or the size of each subpixel). At least some pixels of the display 210 may be driven, for example, based at least in part on the voltage value or the current value such that visual information (e.g., a text, an image, or an icon) corresponding to the image data may be displayed via the display 210.

According to an embodiment, the display device 160 may further include the touch circuitry 250. The touch circuitry 250 may include a touch sensor 251 and a touch sensor IC 253 to control the touch sensor 251. The touch sensor IC 253 may control the touch sensor 251 to sense a touch input or a hovering input with respect to a certain position on the display 210. To achieve this, for example, the touch sensor 251 may detect (e.g., measure) a change in a signal (e.g., a voltage, a quantity of light, a resistance, or a quantity of one or more electric charges) corresponding to the certain position on the display 210. The touch circuitry 250 may provide input information (e.g., a position, an area, a pressure, or a time) indicative of the touch input or the hovering input detected via the touch sensor 251 to the processor 120. According to an embodiment, at least part (e.g., the touch sensor IC 253) of the touch circuitry 250 may be formed as part of the display 210 or the DDI 230, or as part of another component (e.g., the auxiliary processor 123) disposed outside the display device 160.

According to an embodiment, the display device 160 may further include at least one sensor (e.g., a fingerprint sensor, an iris sensor, a pressure sensor, or an illuminance sensor) of the sensor module 176 or a control circuit for the at least one sensor. In such a case, the at least one sensor or the control circuit for the at least one sensor may be embedded in one portion of a component (e.g., the display 210, the DDI 230, or the touch circuitry 150)) of the display device 160. For example, when the sensor module 176 embedded in the display device 160 includes a biometric sensor (e.g., a fingerprint sensor), the biometric sensor may obtain biometric information (e.g., a fingerprint image) corresponding to a touch input received via a portion of the display 210. As another example, when the sensor module 176 embedded in the display device 160 includes a pressure sensor, the pressure sensor may obtain pressure information corresponding to a touch input received via a partial or whole area of the display 210. According to an embodiment, the touch sensor 251 or the sensor module 176 may be disposed between pixels in a pixel layer of the display 210, or over or under the pixel layer.

Figure 3:
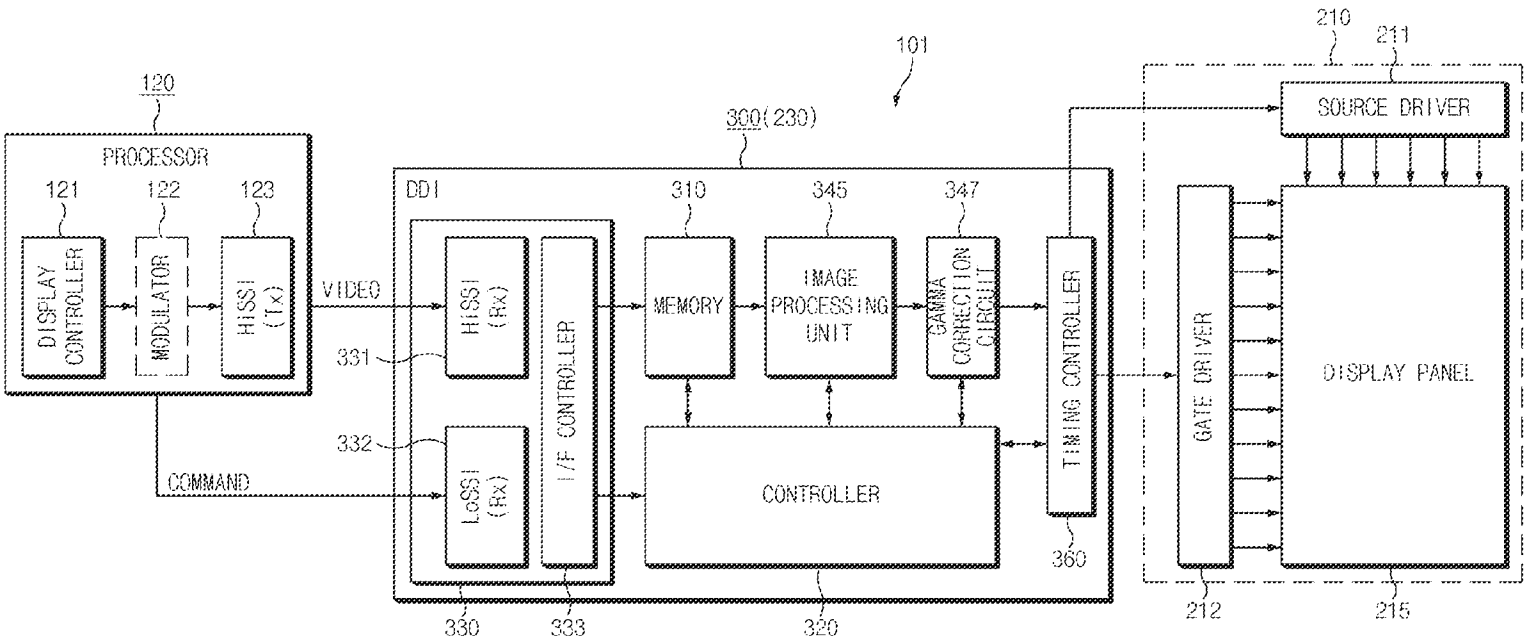
FIG. 3 is a diagram illustrating an electronic device including a DDI according to an embodiment.

FIG. 3 is a diagram illustrating the electronic device 101 including a DDI 300 according to an embodiment.

Referring to FIG. 3, the electronic device 101 according to an embodiment may include the processor 120, the display 210, and the DIN 300. In FIG. 3, with regard to the description given with reference to FIG. 2, redundant descriptions will be omitted.

According to an embodiment, the processor 120 may include at least one or more of an application processor (AP), a communication processor (CP), a sensor hub, and/or a touch screen panel (TSP) IC. It is mainly described in FIG. 3 that the processor 120 performs the role of the AP. However, the processor 120 is not limited to the AP, and may also perform functions of the above-described control circuits.

According to an embodiment, the processor 120 may include a display controller 121, a modulator 122, and a transmission side (Tx) high speed serial interface (HiSSI) 123.

According to an embodiment, the display controller 121 may read image data stored in a memory (e.g., 130 in FIG. 1) or may generate the image data. The image data may represent a screen image according to air activity of an application program. The image data may include data indicating a user authentication screen of an application (e.g., payment applications or bank/security applications requiring the highest security level) to which the security policy of a specified level range is applied, among various differentiated security levels.

According to an embodiment, the modulator 122 may modulate the image data received from the display controller 121. In this specification, "modulation" may mean changing at least part (e.g., all or part) of pixel values constituting image data. For example, the modulation in the modulator 122 may be bypassed when the display controller 121 generates the image data modulated from the beginning. For another example, the modulation in the modulator 122 may be bypassed even when the modulation of the image data is not required.

According to an embodiment, the processor 120 may provide the DDI 300 with the image data and control information to be described later. For example, the image data may be provided to the DIN 300 through the Tx HiSSI 123. For another example, the control information may be transmitted through a Tx low speed serial interface (LoSSI).

According to an embodiment, the DDI 300 may drive the display 210. The DDI 300 may include a memory 310, a controller 320, an interface module 330, an image processing unit 345, a gamma correction circuit 347, and a timing controller 360.

According to an embodiment, the DDI 300 may receive the image data and the control information from the processor 120 through the interface module 330. For example, the encoded image may be received through a reception-side (Rx) HiSSI 331. The control information may be received together with the image data through the Rx HiSSI 331. For another example, the control information may be received through an Rx LoSSI 332 separately from the image data.

According to an embodiment, the memory 310 may store the image data received through the Rx HiSSI 331. For example, the size of the image data may correspond to a storage space of the memory 310. For another example, the storage space of the memory 310 may correspond to the data size of an image corresponding to one frame in a display panel 215. However, the disclosure is not limited thereto. When the memory 310 is implemented to include an auxiliary memory, the storage space of the memory 310 may not correspond to the data size of an image corresponding to one frame in the display panel 215. The memory 310 may be referred to as a frame buffer or a buffer memory. Hereinafter, the image data stored in the memory 310 may be referred to as "first image data" or may be simply referred to a "first image".

According to an embodiment, the controller 320 may control overall operations of the DDI 300. For example, the controller 320 may control the luminance of the display 210 based on the command from the processor 120.

According to an embodiment, the interface module 330 may include the Rx HiSSI 331, the Rx LoSSI 332, and an interface controller 333. The Rx HiSSI 331 may receive an image from the processor 120. The Rx LoSSI 332 may receive the control information. The interface controller 333 may control the Rx HiSSI 331 and the Rx LoSSI 332.

According to an embodiment, the image processing unit 345 may improve image quality by correcting an image. For example, the image processing unit 345 may include one or more of a pixel data processing circuit, a preprocessing circuit, and a gating circuit.

According to an embodiment, the gamma correction circuit 347 may determine or generate a gamma voltage of an electrical signal corresponding to the image data. A relationship between an electrical signal and the brightness of a pixel (e.g., an organic light emitting diode (OLED)) responding to the electrical signal may be non-linear. The gamma correction circuit 347 may determine or correct the gamma voltage of the electrical signal based on a gamma correction curve indicating the non-linear relationship between the electrical signal and the brightness of a pixel, or a look-up table (LUT) created by using the gamma correction curve. Each of the pixels included in the display panel 215 may display an intended image by minimizing image distortion using the gamma correction circuit 347. The controller 320 may adjust and change the gamma correction curve or the LUT, which is used in the gamma correction circuit 347, depending on an image to be displayed.

According to an embodiment, the timing controller 360 may generate a signal corresponding to the received image data to provide the signal to the display 210. The signal generated by the timing controller 360 may be transmitted to a source driver 211 and a gate driver 212 at a specified timing with the specified frame frequency (e.g., 60 Hz).

According to an embodiment, the display 210 may include the source driver 211, the gate driver 212, and the display panel 215. In addition, the display 210 may include other related circuit configurations.

According to an embodiment, the source driver 211 may supply source voltages to source lines included in the display panel 215. The source driver 211 may supply the source voltage corresponding to the luminance, at which an image is displayed for each frame, depending on a control signal received from the timing controller 360.

According to an embodiment, the gate driver 212 may transmit scan signals to scan lines included in the display panel 215. The gate driver 212 may sequentially transmit the scan signals to each of the scan lines depending on the control signal received from the timing controller 360.

According to an embodiment, the display panel 215 may include a plurality of pixels. The plurality of pixels may emit light based on electrical signals from the source driver 211 and the gate driver 212. Various images may be provided to a user by the light emitted from the plurality of pixels.

Figure 4:
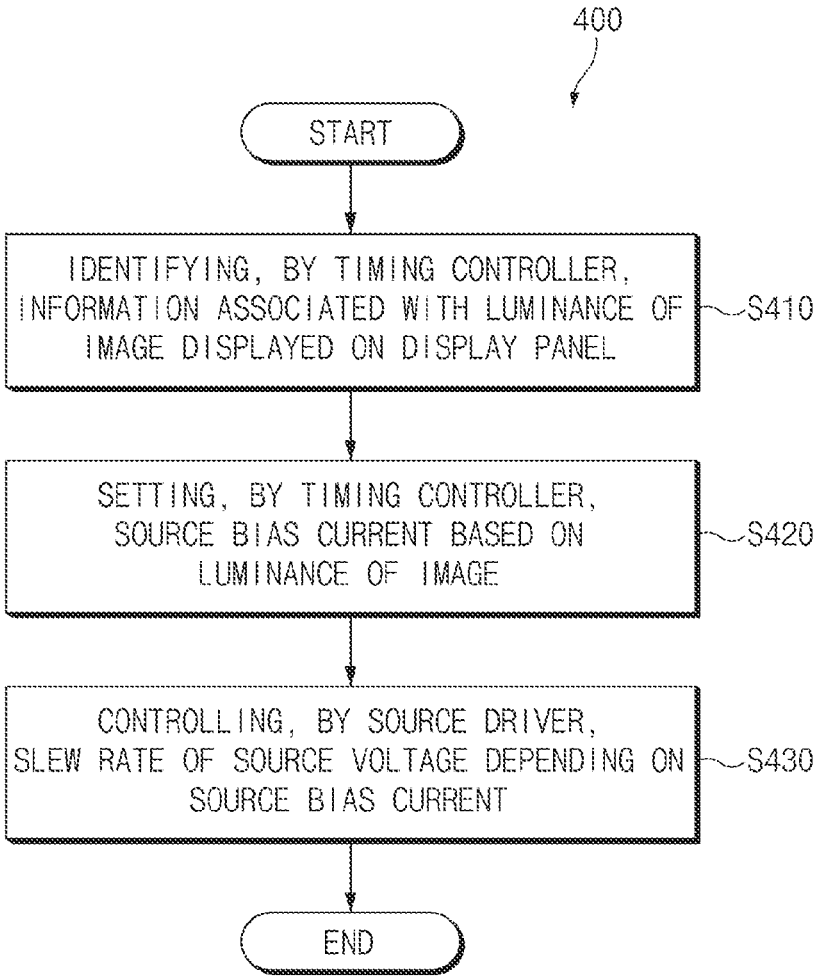
FIG. 4 is a flowchart illustrating an operation of an electronic device according to an embodiment.

FIG. 4 is a flowchart 400 illustrating an operation of the electronic device 101 according to an embodiment.

In operation S410, a dining controller (e.g., the timing controller 360 in FIG. 3) in the electronic device 101 according to an embodiment may identify information associated with the luminance of an image displayed an a display panel (e.g., the display panel 215 of FIG. 3). For example, the timing controller may identify the information associated with the luminance among commands delivered to a DDI (e.g., the DDI 230 of FIG. 3). For another example, the timing controller may receive an illuminance value from an illuminance sensor provided in a display (e.g., the display 210 of FIG. 3).

In operation S420, the timing controller in the electronic device 101 according to an embodiment may set a source bias current based on the luminance of the image. When the luminance change amount of the image is great, the timing controller may be configured to increase the source bias current. When the luminance change amount of the image is small, the timing controller may be configured to decrease the magnitude of the source bias current.

In operation S430, a source driver (e.g., the source driver 211 of FIG. 3) in the electronic device 101 according to an embodiment may control a slew rate of a source voltage depending on the source bias current. In the following specification, the slew rate may be referred to as a "change rate". As the magnitude of the source bias current increases, the source driver may increase the slew rate of the source voltage.

Figure 5:
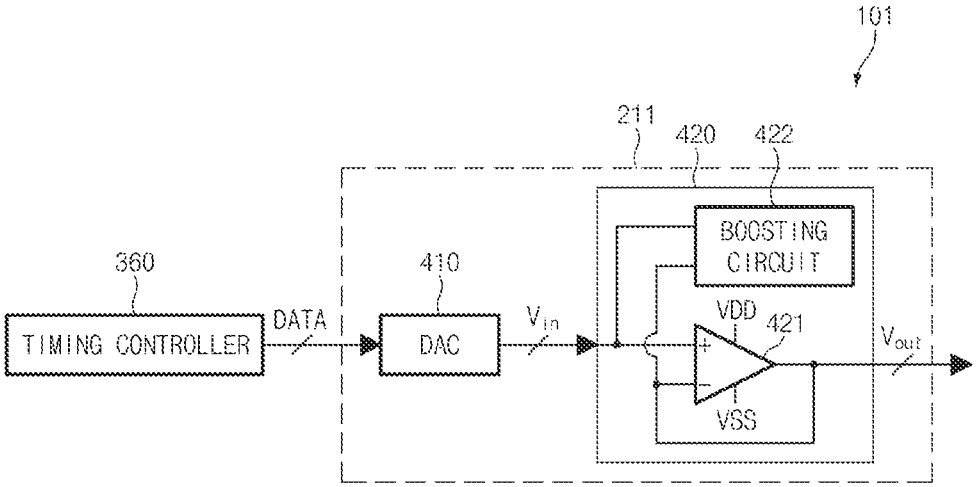
FIG. 5 is a diagram illustrating a source driver of an electronic device according to an embodiment.

FIG. 5 is a diagram illustrating at least part of the source driver 211 of the electronic device 101 according to an embodiment. The source driver 211 may include a digital-analog converter (DAC) 410 and a source voltage generation unit 420.

According to an embodiment, the DAC 410 may receive a digital signal from the timing controller 360. For example, the DAC 410 may receive image data DATA generated by the timing controller 360. The DAC 410 may convert the image data DATA into an analog input voltage Vin.

According to an embodiment, the source voltage generation unit 420 may receive the input voltage Vin. The source voltage generation unit 420 may generate an output voltage Vout based on the input voltage Vin to output the output voltage Vout to a display panel (e.g., the display panel 215 of FIG. 3). Hereinafter, the output voltage Vout may be referred to as a "source voltage". The source voltage generation unit 420 may include an amplifier circuit 421 and a boosting circuit 422.

According to an embodiment, the amplifier circuit 421 may amplify the input voltage Vin to generate the output voltage Vout. The amplifier circuit 421 may receive the input voltage Vin through an input terminal. For example, the amplifier circuit 421 may receive the input voltage Vin through a positive terminal (+) of the amplifier circuit 421. The amplifier circuit 421 may be connected to the boosting circuit 422. For example, a negative terminal (−) of the amplifier circuit 421 may be connected to the boosting circuit 422. The amplifier circuit 421 may be implemented as an operational amplifier (OP-Amp). The amplifier circuit 421 implemented as the OP-Amp may receive power through power terminals VDD and VSS.

According to an embodiment, the boosting circuit 422 may be connected to the amplifier circuit 421. The boosting circuit 422 may supply a current according to the input voltage Vin to the amplifier circuit 421. For example, the boosting circuit 422 may supply the current to the input terminal of the amplifier circuit 421. For another example, the boosting circuit 422 may provide the current to the amplifier circuit 421 to a path for connecting the input terminal and the output terminal of the amplifier circuit 421. The boosting circuit 422 may control the output voltage Vout of the amplifier circuit 421.

According to an embodiment, the boosting circuit 422 may supply a boosting current to the amplifier circuit 421. The boosting current may be obtained by at least temporarily increasing the magnitude of the current during 1 frame defined by a vertical synchronization signal Vsync. For example, when there is a sudden luminance change such as a change from a black grayscale to a white grayscale or a change from a white grayscale to a black grayscale during 1 frame, the source driver 211 may output the output voltage Vout such that the source voltage is significantly changed based on a change in luminance within 1 frame. It is necessary to at least temporarily significantly increase the magnitude of the current for setting the output voltage Vout for the purpose of significantly changing the output voltage Vout within 1 frame in a moment of time.

According to an embodiment, when the magnitude of the current supplied by the boosting circuit 422 increases, the time required until the source voltage output by the source voltage generation unit 420 reaches the level of a target voltage may decrease. Accordingly, the slew rate of the source voltage that is a speed, at which the source voltage reaches up to the level of the target voltage, may increase. When the slew rate of the source voltage is increased, the source voltage may be rapidly changed to the desired voltage in a start section of 1 frame where the source voltage is changed. Accordingly, when the change amount of the source voltage is great in the start section of 1 frame, the source voltage may be changed to the desired voltage within a specified section. For example, when the source voltage in the start section of 1 frame is a white voltage of about 4 V, and the desired voltage level of the source voltage is a black voltage of about 6.5 V, the change amount of the source voltage may be about 2.5 V. Accordingly, the source voltage may be rapidly increased from about 4 V to about 6.5 V by temporarily increasing the intensity of the current supplied by the boosting circuit 422 in the start section.

Figure 6:
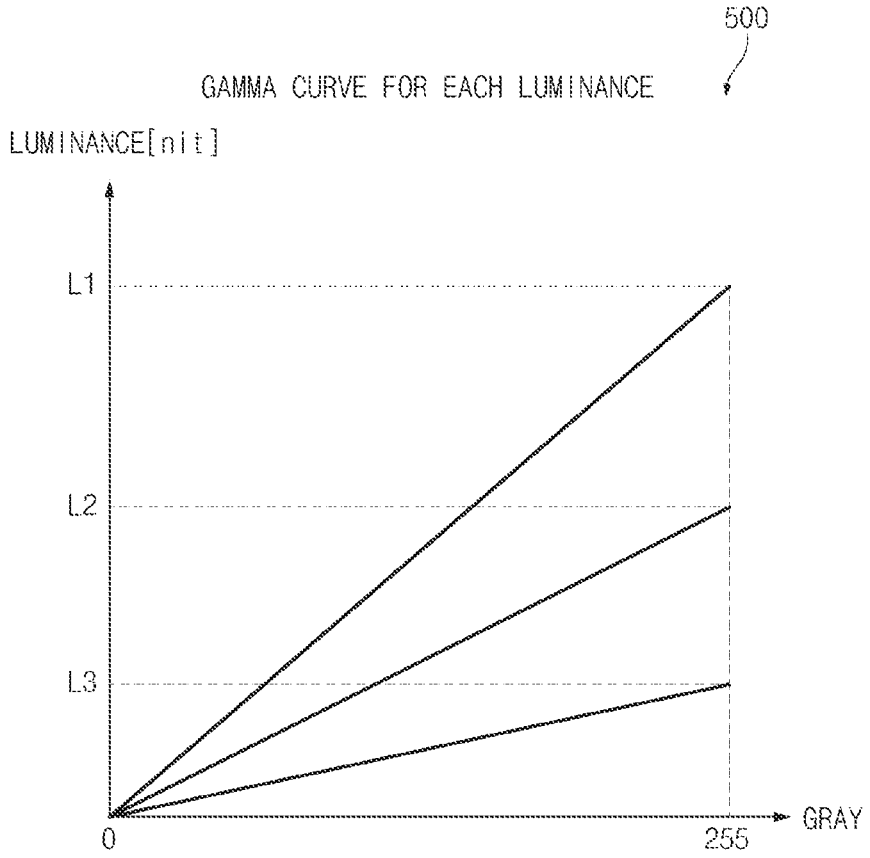
FIG. 6 is a graph illustrating a gamma curve according to a luminance of an image displayed by a display of an electronic device according to an embodiment.

FIG. 6 is a graph 500 illustrating a gamma curve according to a luminance of an image displayed by the display 210 of the electronic device 101 according to an embodiment.

According to an embodiment, the electronic device may divide a grayscale of an image displayed by the display 210 into a plurality of levels to represent the image. For example, the grayscale of the image displayed by the display 210 may be divided into 256 levels from gray level 0 to gray level 255 to represent the image. As a grayscale level increases, a gamma curve may rise. FIG. 5 illustrates that a gamma value proportionally increases as the grayscale level increases. However, the disclosure is not limited thereto. For example, the gamma value may increase non-linearly as the grayscale level increases.

According to an embodiment, the gamma curve may be changed depending on the luminance of the image displayed by the display 210. For example, when the image displayed by the display 210 has one of first to third luminances L1 to L3, the electronic device may have gamma curves respectively corresponding to the first to third luminances L1 to L3.

According to an embodiment, the first luminance L1 may be the highest luminance among the plurality of luminances capable of representing the image displayed by the display 210. For example, the first luminance L1 may be 420 nit. The second luminance L2 may be an intermediate luminance among the plurality of luminances capable of representing the image displayed by the display 210. For example, the second luminance L2 may be 200 nit. The third luminance L3 may be the lowest luminance among the plurality of luminances capable of representing the image displayed by the display 210. For example, the third luminance L3 may be 10 nit.

According to an embodiment, when the image displayed by the display 210 has the first luminance L1, the gamma curve may increase from 0 to a first gamma value as the grayscale value is changed from gray level 0 to gray level 255. When the image displayed by the display 210 has the second luminance L2, the gamma curve may increase from 0 to a second gamma value as the grayscale value changes from gray level 0 to gray level 255. The second gamma value may be less than the first gamma value. When the image displayed by the display 210 has the third luminance L3, the gamma curve may increase from 0 to the third gamma value as the grayscale value changes from gray level 0 to gray level 255. The third gamma value may less than the second gamma value. As such, as the luminance decreases, the change amount of the gamma value according to a change in grayscale value may be reduced.

Figure 7:
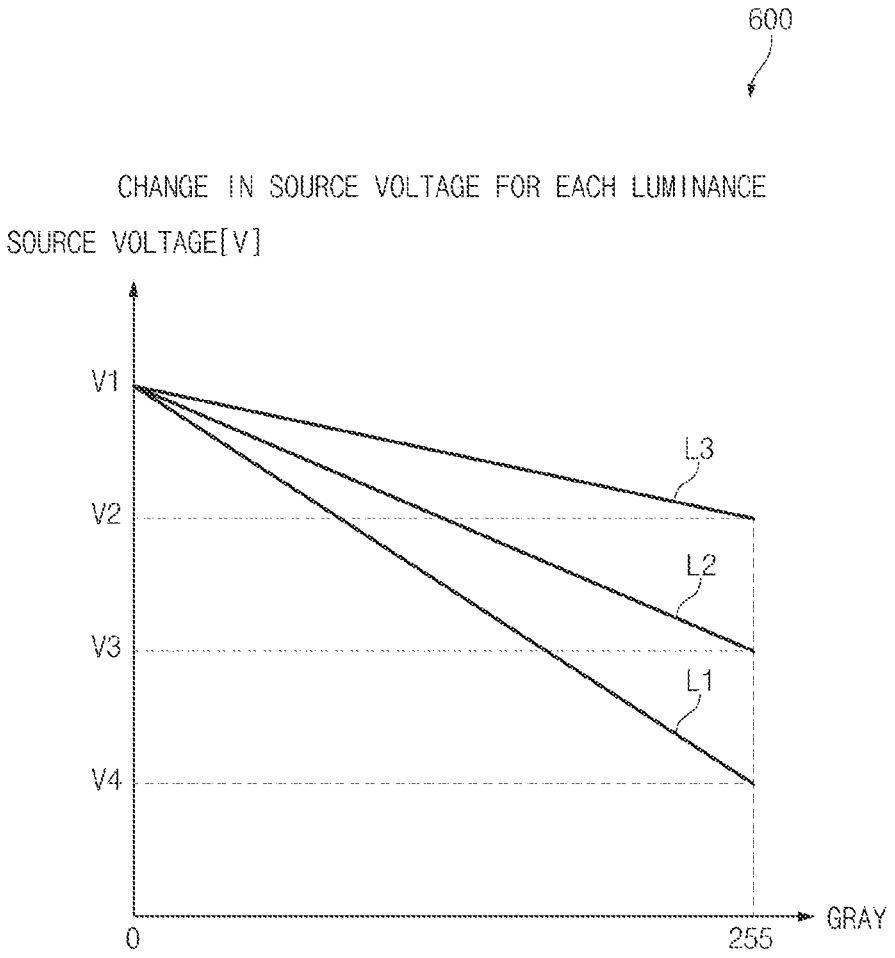
FIG. 7 is a graph illustrating a change of a source voltage according to a luminance of an image displayed by a display of an electronic device according to an embodiment.

FIG. 7 is a graph 600 illustrating a change of a source voltage according to a luminance of an image displayed by the display 210 of the electronic device 101 according to an embodiment.

According to an embodiment, a gamma curve may be changed when a luminance is changed, and thus a swing range of a source voltage may be changed. For example, when the change amount of the gamma curve decreases, the change amount of the source voltage may decrease. For example, when the image displayed by the display 210 has one of the first to third luminances L1 to L3, the electronic device may have source voltages respectively corresponding to the first to third luminances L1 to L3.

According to an embodiment, when the grayscale value is gray level 0, the source voltage have a uniform value regardless of a luminance. When the grayscale value is gray level 0, the source voltage may have a maximum value. In the case of gray level 0, the source voltage at the first to third luminances L1 to L3 may be a first voltage V1. For example, the first voltage V1 may be about 6.5 V.

According to an embodiment, as the gray level, which is the grayscale value, increases, the source voltage may decrease. When the grayscale value is gray level 255, the source voltage may have a minimum value.

According to are embodiment, a decrement of the source voltage may increase as the luminance increases. The level of the source voltage at gray level 255 may decrease as the luminance increases. For example, at the third luminance L3 that is a low luminance, the source voltage at gray level 255 may be a second voltage V2. In the first luminance L1 that is a high luminance, the source voltage at gray level 255 may be a fourth voltage V4 lower than the second voltage V2. The change amount of the source voltage may increase as the luminance increases. For example, at the third luminance L3 that is a low luminance, the decrement of the source voltage may be a difference value between the first voltage V1 and the second voltage V2. In the first luminance L1 that is a high luminance, the decrement of the source voltage may be a difference value between the first voltage V1 and the fourth voltage V4. Because the fourth voltage V4 is lower than the second voltage V2, the decrement of the source voltage at the first luminance L1 that is a high luminance may be greater than the decrement of the source voltage at the third luminance L3 that is low luminance.

According to an embodiment, at gray level 255, the source voltage at the third luminance L3 may be the second voltage V2. For example, the second voltage V2 may be about 6 V. In the case of gray level 255, the source voltage at the second luminance L2 may be a third voltage V3. The third voltage V3 may be lower than the second voltage V2. For example, the third voltage V3 may be about 5 V. At gray level 255, the source voltage at the first luminance may be the fourth voltage V4. The fourth voltage V4 may be lower than the third voltage V3. For example, the fourth voltage V4 may be about 4 V.

Figure 8:
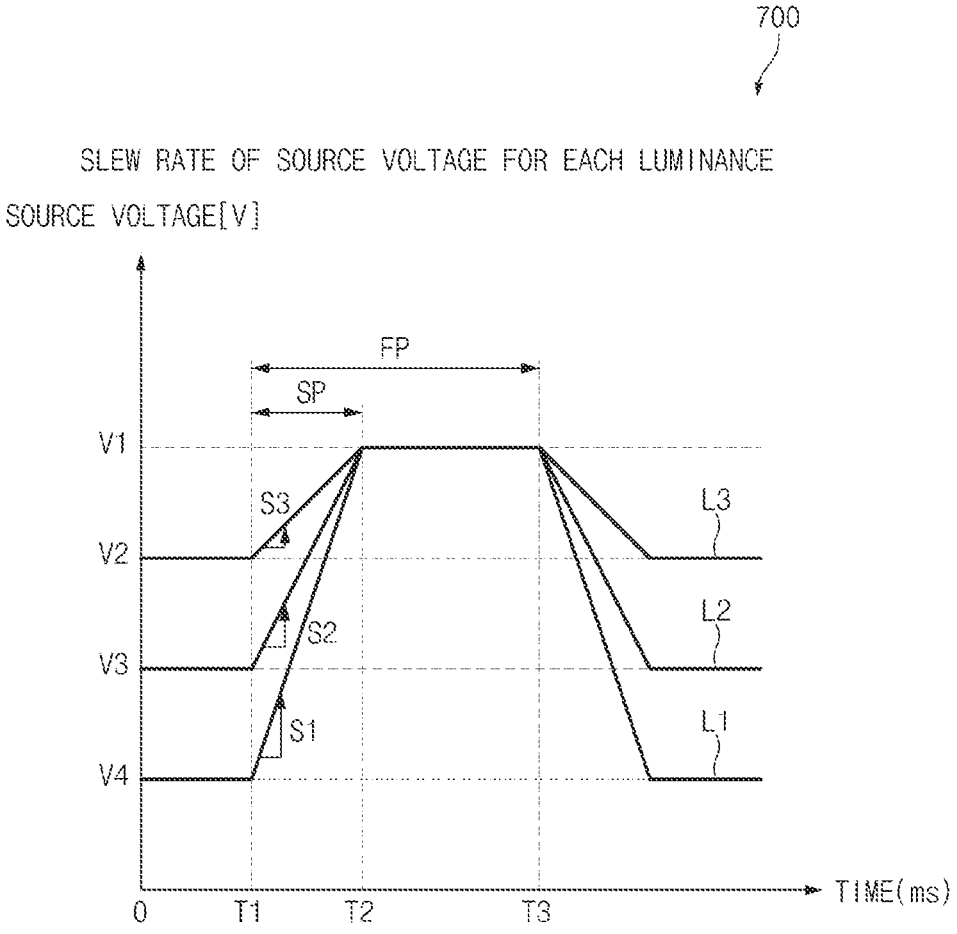
FIG. 8 is a graph illustrating a slew rate of a source voltage according to a luminance of an image displayed by a display of an electronic device according to an embodiment.

FIG. 8 is a graph 700 illustrating a slew rate of a source voltage according to a luminance of an image displayed by the display 210 of the electronic device 101 according to an embodiment.

According to an embodiment, a DDI (e.g., the DDI 230 of FIG. 2) of the electronic device 101 may set the luminance of an image displayed by the display 210, depending on commands delivered from a processor (e.g., the processor 120 of FIG. 1) to the DDI for at least each part of a frame period FP. The display 210 may set the luminance of an image displayed depending on a command received in the previous frame period FP within the frame period FP in which the command is not delivered.

According to an embodiment, the command delivered by the processor to the DDI may be included in an image control signal. For another example, the command may control image data. In this case, image information delivered from the processor to the DDI may include the image control signal corresponding to the command. The frame period FP may last from a first time point T1 to a second time point T2 and from the second time point T2 to a third time point T3. Accordingly, the frame period FP may be defined as a period from the first time point T1 to the third time point T3.

According to another embodiment, when a sensor module (e.g., the sensor module 176 of FIG. 2) included in a display device (e.g., the display device 160 of FIG. 2) is connected to the DDI (e.g., the DDI 230 of FIG. 2), the value sensed by a sensor module may be delivered to the DDI. For example, when the sensor module includes an illuminance sensor and is directly connected to the DDI by using an interface, the illuminance value sensed by the illuminance sensor may be directly delivered to the DDI through the interface. For another example, the illuminance sensor included in the sensor module may be connected to a sensor hub of an auxiliary processor (e.g., the auxiliary processor 123 in FIG. 1), and the sensor hub may be connected to the DDI. The illuminance value sensed by the illuminance sensor may be delivered to the DDI by using the sensor hub. The control module inside the DDI may include an LUT having a luminance value corresponding to the illuminance value. Accordingly, the DDI may directly set a luminance value corresponding to the delivered illuminance value.

According to an embodiment, a timing controller (e.g., the timing controller 360 of FIG. 3) may increase the source voltage to the minimum value or more set depending on the luminance within 1 frame period FP. The timing controller may decrease the source voltage to the specified maximum value or less after the end of 1 frame period FP. For example, the timing controller may increase the source voltage from the minimum value, which is set depending on the luminance, to the maximum value in a slew period SP within 1 frame period FP. The slew period SP may last from the first time point T1 to the second time point T2.

According to an embodiment, the source voltage at the first luminance L1 may increase to the first voltage V1 in 1 frame period FP while being maintained at the fourth voltage V4, and then may decrease to the fourth voltage V4 at the end of 1 frame period FP. The source voltage at the second luminance L2 may increase to the first voltage V1 in 1 frame period FP while being maintained at the third voltage V3, and then may decrease to the third voltage V3 at the end of 1 frame period FP. The source voltage at the third luminance L3 may increase to the first voltage V1 in 1 frame period FP while being maintained at the second voltage V2, and then may decrease to the second voltage V2 at the end of the 1 frame period FP.

According to an embodiment, a magnitude change of the source voltage at the first luminance L1, which is the brightest luminance, from among the first to third luminances L1 to L3 may be greatest within 1 frame period FP. A magnitude change of the source voltage at the third luminance L3, which is the darkest luminance, from among the first to third luminances L1 to L3 may be smallest within 1 frame period FP. At the second luminance L2 darker than first luminance L1 and brighter than the third luminance L3, the change amount of the source voltage within 1 frame period FP may be smaller than the change amount at the first luminance L1 and may be greater than the change amount at the third luminance L3.

According to an embodiment, the source voltage at the first luminance L1 may increase from the fourth voltage V4 to the first voltage V1 during the slew period SP. The source voltage at the first luminance L1 may increase at a first slew rate S1. The source voltage at the second luminance L2 may increase from the third voltage V3 to the first voltage V1 during the slew period SP. The source voltage at the second luminance L2 may increase at a second slew rate S2 lower than the first slew rate S1. The source voltage at the third luminance L3 may increase from the second voltage V2 to the first voltage V1 during the slew period SP. The source voltage at the third luminance L3 may increase at a third slew rate S3 lower than the second slew rate S2.

According to an embodiment, the source voltage may increase from the minimum value to the maximum value during the same time regardless of the luminance of the image displayed by the display 210. In all the cases of having the first luminance L1 to third luminance L3, the DDI 230 of the electronic device 101 may control the source driver 211 such that the source voltage increases from the minimum value to the maximum value during the slew period SP of the same length, by calculating the first to third slew rates S1 to S3 based on the levels of the first to fourth voltages V1 to V4.

According to an embodiment, when the change amount of the source voltage is reduced, the DDI 230 of the electronic device 101 may control the source driver 211 so as to reduce the slew rate of the source voltage. For example, when the change amount of the source voltage decreases to the specified width or less, the DDI 230 of the electronic device 101 may control the source driver 211 so as not to use the boosting circuit (e.g., the boosting circuit 422 of FIG. 4). When the change amount of the source voltage decreases to the specified width or less, the DDI 230 of the electronic device 101 may turn off a fast slew function rising the boosting circuit 422, and thus may reduce the power consumed by the source driver 211.

Figure 9:
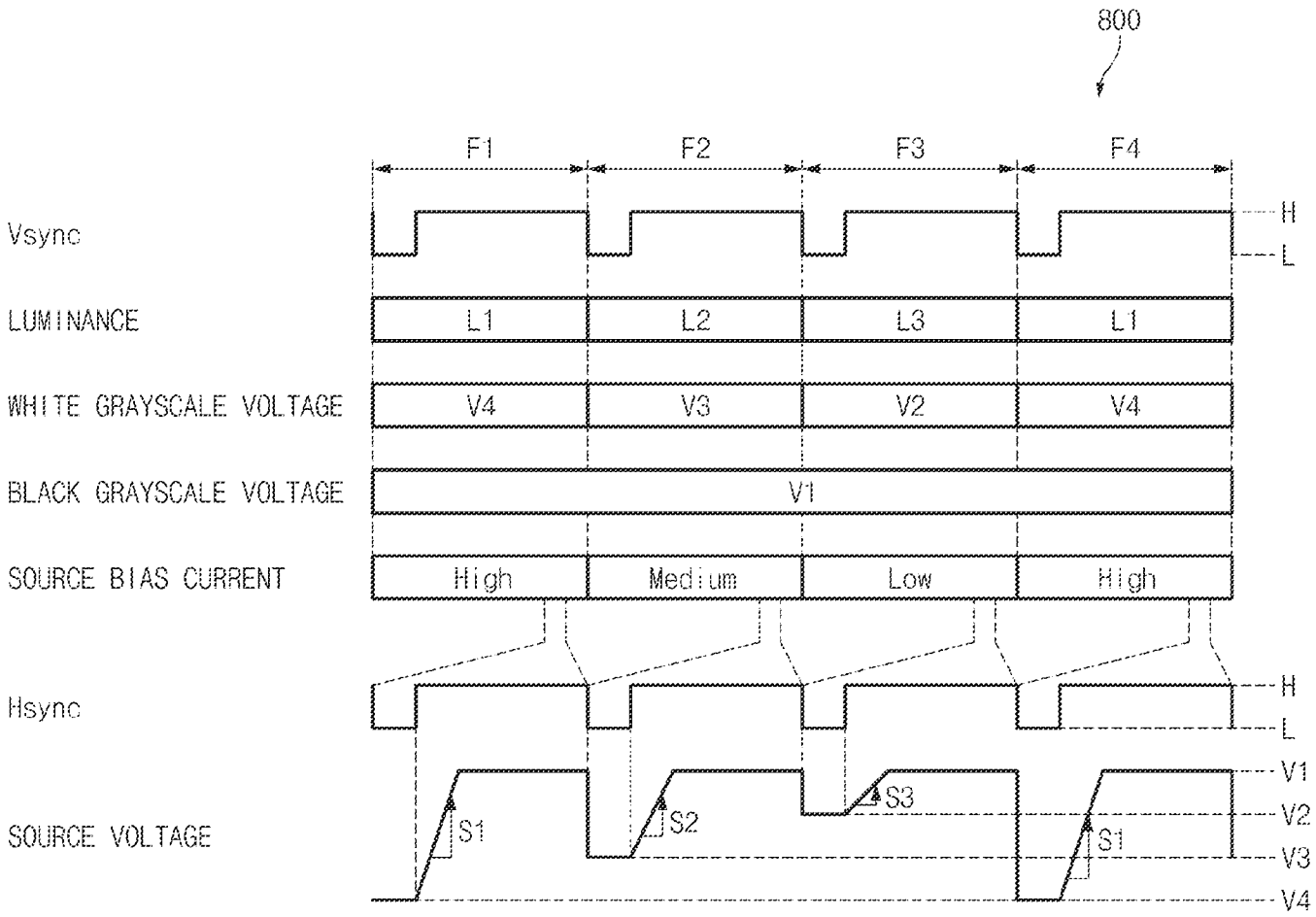
FIG. 9 is a graph illustrating a vertical synchronization signal, luminance, a white grayscale voltage, a black grayscale voltage, a source bias current, a horizontal synchronization signal, and a source voltage in units of frames of an electronic device according to an embodiment.

FIG. 9 is a graph 800 illustrating a vertical synchronization signal Vsync, a luminance, a white grayscale voltage, a black grayscale voltage, a source bias current, a horizontal synchronization signal Hsync, and a source voltage for each of frames F1 to F4 of the electronic device 101 according to an embodiment. The frames F1 to F4 may include first to fourth frames F1 to F4.

According to an embodiment, the electronic device 101 may sequentially proceed with the first to fourth frames F1 to F4 depending on the vertical synchronization signal Vsync, which is generated by a timing controller (e.g., timing controller 360 of FIG. 3) and then is transmitted to a source driver (e.g., the source driver 211 of FIG. 3). At the beginning of the next frame after the end of one frame, the vertical synchronization signal Vsync may be at least temporarily changed from a high state (H) to a low state (L). For example, at the beginning of the second frame F2 after the end of the first frame F1, the vertical synchronization signal Vsync may temporarily change from the high state (H) to the low state (L) and then may be changed to the high state (H).

According to an embodiment, the electronic device 101 may set a luminance based on a command delivered from the processor (e.g., the processor 120 of FIG. 1) to the DDI (e.g., the DDI 230 of FIG. 2) in units of frames. The timing controller of the electronic device 101 may change the luminance in units of frames. For example, in the first frame F1, the display (e.g., the display 210 of FIG. 2) may have the first luminance L1. In the second frame F2, the display 210 may have the second luminance L2. In the third frame F3, the display 210 may have the third luminance L3. In the fourth frame F4, the display 210 may have the first luminance L1.

According to an embodiment, the source driver 211 of the electronic device 101 may set a white grayscale voltage according to the luminance in units of frames. The white grayscale voltage may be the source voltage at gray level 255. The white grayscale voltage may be the same as the minimum value of the source voltage. The source driver 211 of the electronic device 101 may change and output the white grayscale voltage in units of frames. For example, in the first frame F1, the source driver 211 may output the white grayscale voltage of the fourth voltage V4. In the second frame F2, the source driver 211 may output the white grayscale voltage of the third voltage V3. In the third frame F3, the source driver 211 may output the white grayscale voltage of the second voltage V2. In the fourth frame F4, the source driver 211 may output the white grayscale voltage of the fourth voltage V4.

According to an embodiment, the source driver 211 of the electronic device 101 may be configured to maintain a uniform black grayscale voltage regardless of a luminance. The black grayscale, voltage may be the source voltage at gray level 0. The black grayscale voltage may be the same value as the maximum value of the source voltage. The source driver 211 of the electronic device 101 may output the black grayscale voltage. For example, in the first to fourth frames F1 to F4, the source driver 211 may output the black grayscale voltage of the first voltage V1.

According to an embodiment, the source driver 211 of the electronic device 101 may control the magnitude of the source bias current for changing the source voltage in units of frames. The source driver 211 may control the magnitude of the source bias current to be changed depending on the luminance in each frame, using a boosting circuit (e.g., the boosting circuit 422 of FIG. 4). For example, the boosting circuit 422 of the source driver 211 may set the intensity of the source bias current to "High" in the first frame F1. The boosting circuit 422 of the source driver 211 may set the intensity of the source bias current to "Medium" in the second frame F2. The boosting circuit 422 of the source driver 211 may set the intensity of the source bias current to "Low" in the third frame F3. The boosting circuit 422 of the source driver 211 may set the intensity of the source bias current to "High" in the fourth frame F4.

According to an embodiment, in at least part of the first to fourth frames F1 to F4, the electronic device 101 may propagate the horizontal synchronization signal Hsync which is generated by the timing controller 360 and then is transmitted to the source driver 211, for each scan line on the display panel (e.g., the display panel 215 of FIG. 3). The horizontal synchronization signal Hsync may be at least temporarily changed from the high state (H) to the low state (L) sequentially for each scan line in at least part of the first to fourth frames F1 to F4. For example, in at least part of periods within the first to fourth frames F1 to F4, the horizontal synchronization signal Hsync may be temporarily changed from the high state (H) to the low state (L) and then may be changed to the high state (H).

According to an embodiment, the source driver 211 of the electronic device 101 may increase the source voltage from a white grayscale voltage to a black grayscale voltage in at least part of frame unit periods. At the time point where the horizontal synchronization signal Hsync is temporarily changed to the low state (L) and then is changed to the high state (H), the source driver 211 may increase the source voltage from the white grayscale voltage to the black grayscale voltage. For example, the source driver 211 may increase the source voltage from the fourth voltage V4 to the first voltage V1 in at least part of the first frame F1. The source driver 211 may increase the source voltage from the third voltage V3 to the first voltage V1 in at least part of the second frame F2. The source driver 211 may increase the source voltage from the second voltage V2 to the first voltage V1 in at least part of the third frame F3. The source driver 211 may increase the source voltage from the fourth voltage V4 to the first voltage V1 in at least part of the fourth frame F4.

According to an embodiment, the source driver 211 may control the slew rate of the source voltage depending on the luminance of the image displayed on the display 210. For example, when the image displayed on the display 210 has the first luminance L1, the source driver 211 may control the source voltage to have the first slew rate S1. When the image displayed on the display 210 has the second luminance L2, the source driver 211 may control the source voltage to have the second slew rate S2. When the image displayed on the display 210 has the third luminance L3, the source driver 211 may control the source voltage to have the third slew rate S3.

Figure 10:
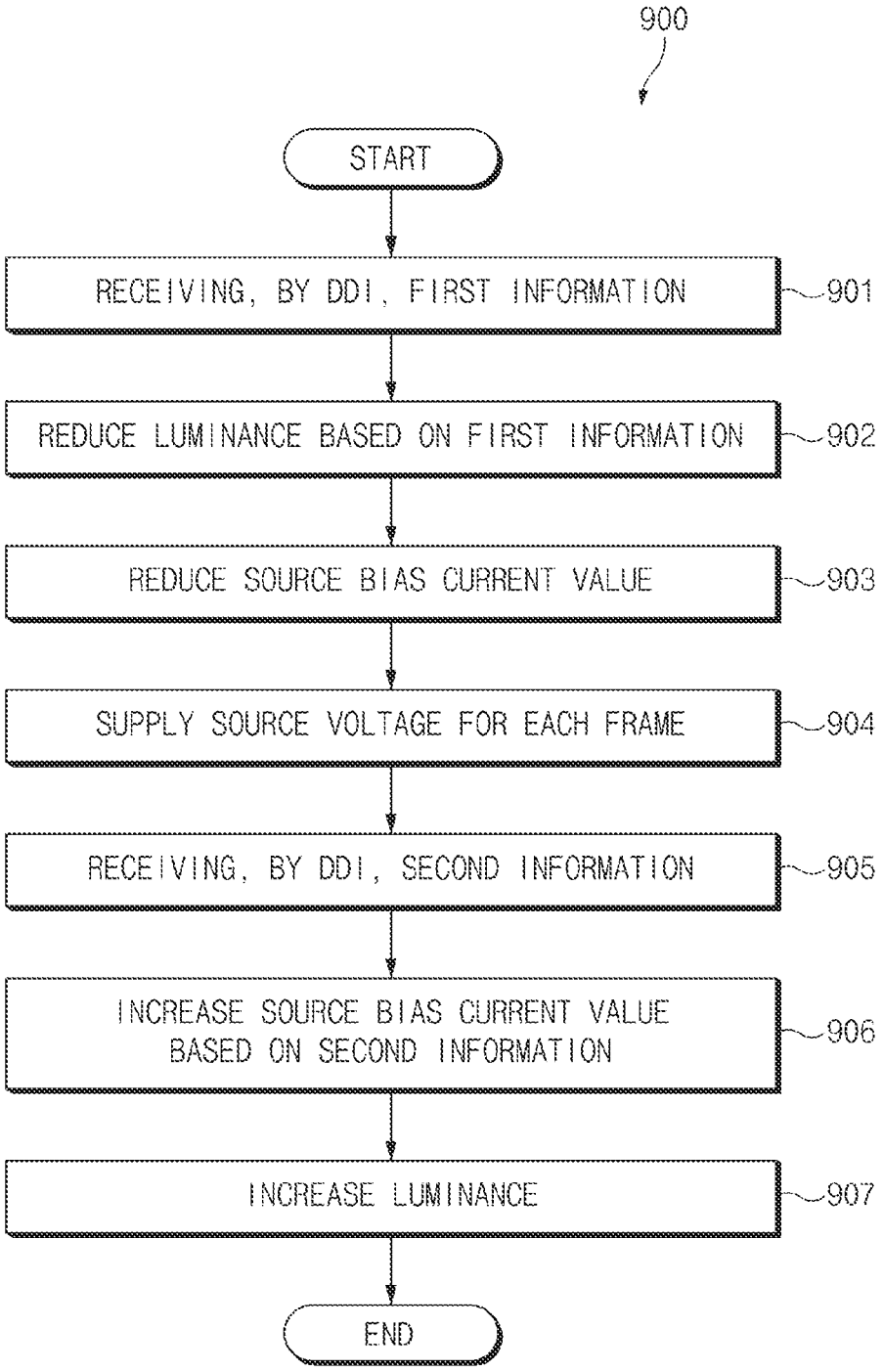
FIG. 10 is a flowchart illustrating an operation, in which an electronic device controls luminance, according to an embodiment.

FIG. 10 is a flowchart 900 illustrating an operation, in which the electronic device 101 controls luminance, according to an embodiment.

In operation 901, a DDI (e.g., the DDI 230 of FIG. 2) in the electronic device 101 according to an embodiment may receive first information. For example, the DDI may receive the first information including a command for changing a luminance from a processor (e.g., the processor 120 of FIG. 1). For another example, the DDI may receive the first information including an illuminance value sensed from an illuminance sensor included in a sensor module the sensor module 176 of FIG. 2). The first information may be used to reduce the luminance of an image displayed on a display (e.g., the display 210 of FIG. 2).

In operation 902, the electronic device 101 according to an embodiment may reduce the luminance based on the first information. The timing controller (e.g., the timing controller 360 of FIG. 3) of the DDI 230 may change the luminance by changing the source voltage output by the source driver 211 based on the first command. For example, the source driver 211 may decrease the luminance of the image displayed on the display panel (e.g., the display panel 215 of FIG. 3) by increasing the white grayscale voltage of the output source voltage.

In operation 903, the electronic device 101 according to an embodiment may reduce a source bias current value. The source driver 211 may reduce the source bias current value that is output from a boosting circuit (e.g., the boosting circuit 422 of FIG. 4) to an amplifier circuit (e.g., the amplifier circuit 421 of FIG. 4). For example, when the display 210 displays an image having a specified luminance or less, the source driver 211 may turn off the fast slew function of the boosting circuit 422. Under control of the timing controller 360 of the DDI 230, the source bias current value output from the boosting circuit 422 of the source driver 211 may be decreased.

In operation 904, the electronic device 101 according to an embodiment may supply the source voltage for each frame. The source driver 211 may supply a source voltage corresponding to the luminance, which is set based on the first command for each frame, to the display panel 215. The display panel 215 may display an image of the luminance set depending on the received source voltage.

In operation 905, the DDI 230 in the electronic device 101 according to an embodiment may receive second information. For example, the DDI may receive the second information including a command for changing a luminance from a processor. For another example, the DDI may receive the second information including an illuminance value sensed from an illuminance sensor included in a sensor module. The second information may be used to increase the luminance of an image displayed on the display 210.

In operation 906, the electronic device 101 according to an embodiment may increase the source bias current value based on the second information. The source driver 211 may increase the source bias current value output from the boosting circuit 422 to the amplifier circuit 421 based on the second information. For example, when the display 210 displays an image having a specified luminance or more, the source driver 211 may turn on the fast slew function of the boosting circuit 422. Under control of the timing controller 360 of the DDI 230, the source bias current value output from the boosting circuit 422 of the source driver 211 may be increased.

In operation 907, the electronic device 101 according to an embodiment may increase the luminance. The timing controller 360 of the DDI 230 may change the luminance by changing the source voltage output from the source driver 211 based on the increased source bias current value. The source driver 211 may increase the luminance of the image displayed on the display panel 215 by decreasing the white grayscale voltage of the output source voltage.

Figure 11:
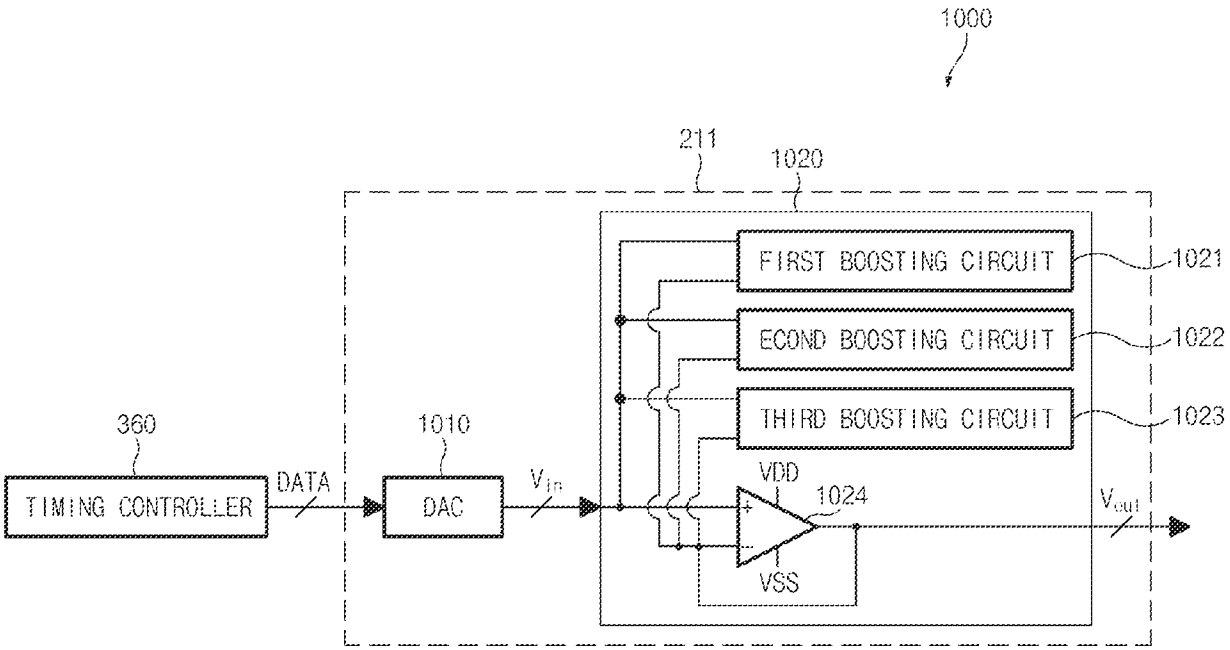
FIG. 11 is a diagram illustrating a source driver of an electronic device according to another embodiment.

FIG. 11 is a diagram illustrating the source driver 211 of an electronic device 1000 according to another embodiment. The source driver 211 may include a DAC 1010 and a source voltage generation unit 1020.

According to an embodiment, the DAC 1010 may receive a digital signal from the timing controller 360. For example, the DAC 1010 may receive image data DATA generated by the timing controller 360. The DAC 1010 may convert the image data DATA into an analog input voltage Vin.

According to an embodiment, the source voltage generation unit 1020 may receive the input voltage Vin. The source voltage generation unit 1020 may generate an output voltage Tout based on the input voltage Vin to output the output voltage Vout to a display panel (e.g., the display panel 215 of FIG. 3). Hereinafter, the output voltage Vout may be referred to as a "source voltage". The source voltage generation unit 1020 may include an amplifier circuit 1024 and one or more boosting circuits 1021 to 1023. For example, the source voltage generation unit 1020 may include the first to third boosting circuits 1021 to 1023.

According to an embodiment, the amplifier circuit 1024 may amplify the input voltage Vin to generate the output voltage Vout. The amplifier circuit 1024 may receive the input voltage Vin through an input terminal. For example, the amplifier circuit 1024 may receive the input voltage Vin through a positive terminal (+) of the amplifier circuit 421. The amplifier circuit 1024 may be connected to first to third boosting circuits 1021 to 1023. For example, a negative terminal (−) of the amplifier circuit 1024 may be connected to the first to third boosting circuits 1021 to 1023. The amplifier circuit 1024 may be implemented as an OP-Amp. The amplifier circuit 1024 implemented as the OP-Amp may receive power through power terminals VDD and VSS.

According to an embodiment, the first to third boosting circuits 1021 to 1023 may be connected to the amplifier circuit 1024. The first to third boosting circuits 1021 to 1023 may respectively supply source bias currents, which have different magnitudes from one another, to the amplifier circuit 1024. The source bias current may be a current that sets the slew rate, which is the change rate of the source voltage. For example, the first boosting circuit 1021 may set the slew rate of the source voltage to a first slew rate; the second boosting circuit 1022 may set the slew rate of the source voltage to a second slew rate lower than the first slew rate; and, the third boosting circuit 1023 may set the slew rate of the source voltage to a third slew rate lower than the second slew rate. The amplifier circuit 1024 may change the output voltage Vout depending on the set slew rate by using source bias currents having different magnitudes supplied from the first to third boosting circuits 1021 to 1023.

Figure 12:
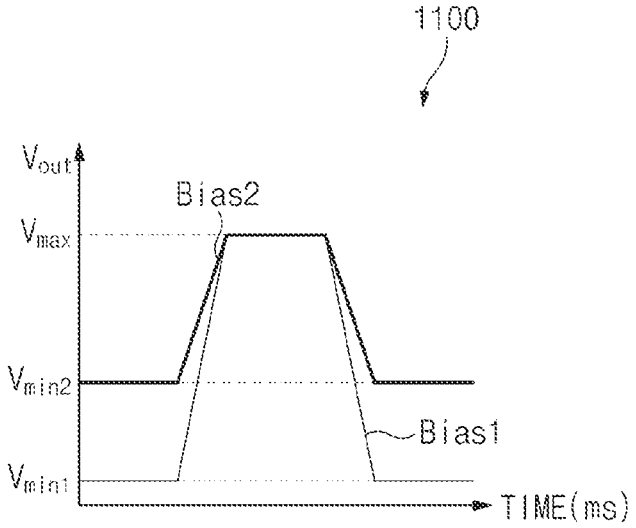
FIG. 12 is a graph illustrating a change of a source voltage according to source bias currents in detail according to another embodiment.

FIG. 12 is a graph 1100 illustrating a change of a source voltage according to source bias currents Bias1 and Bias2 in detail according to another embodiment.

According to an embodiment, the electronic device 101 may supply source bias currents Bias1 and Bias2 by selecting one of one or more boosting circuits depending on the luminance of an image displayed on a display panel (e.g., the display panel 215 of FIG. 3). For example, when the display panel 215 displays an image having a high luminance, the source driver (e.g., the source driver 211 of FIG. 3) may rapidly increase the source voltage from a first minimum value Vmin1 to a maximum value Vmax by supplying a first source bias current Bias1. For another example, when the display panel 215 displays an image having a low luminance, the source driver 211 may increase the source voltage from a second minimum value Vmin2 to the maximum value Vmax slowly (e.g., relatively slowly as compared to the case of supplying the first source bias current Bias1) by supplying a second source bias current Bias2.

According to an embodiment, one or more boosting circuits (e.g., the first to third boosting circuits 1021 to 1023 of FIG. 11) of the electronic device 1000 may supply boosting currents of different magnitudes to the amplifier circuit 1024, respectively. The boosting current may be a current that at least temporarily increases a magnitude of a current during 1 frame defined by the vertical synchronization signal. When the magnitude of the current is increased, the slew rate of the source voltage, which is the change rate of the source voltage output from the source voltage generation unit 420, may increase. When the slew rate of the source voltage is increased, the source voltage may be rapidly changed to the desired voltage in a start section of 1 frame where the source voltage is changed. Besides, when the slew rate of the source voltage is reduced, the power consumed by the source driver 211 may be reduced. For example, when the difference between the maximum value Vmax and the minimum value Vmin of the source voltage within 1 frame is great, the slew rate may be increased to increase the source voltage within the specified time. When the difference value between the maximum value Vmax and the minimum value Vmin of the source voltage within 1 frame is small, the slew rate may be decreased to reduce the power consumption of the source driver 211.

Figure 13:
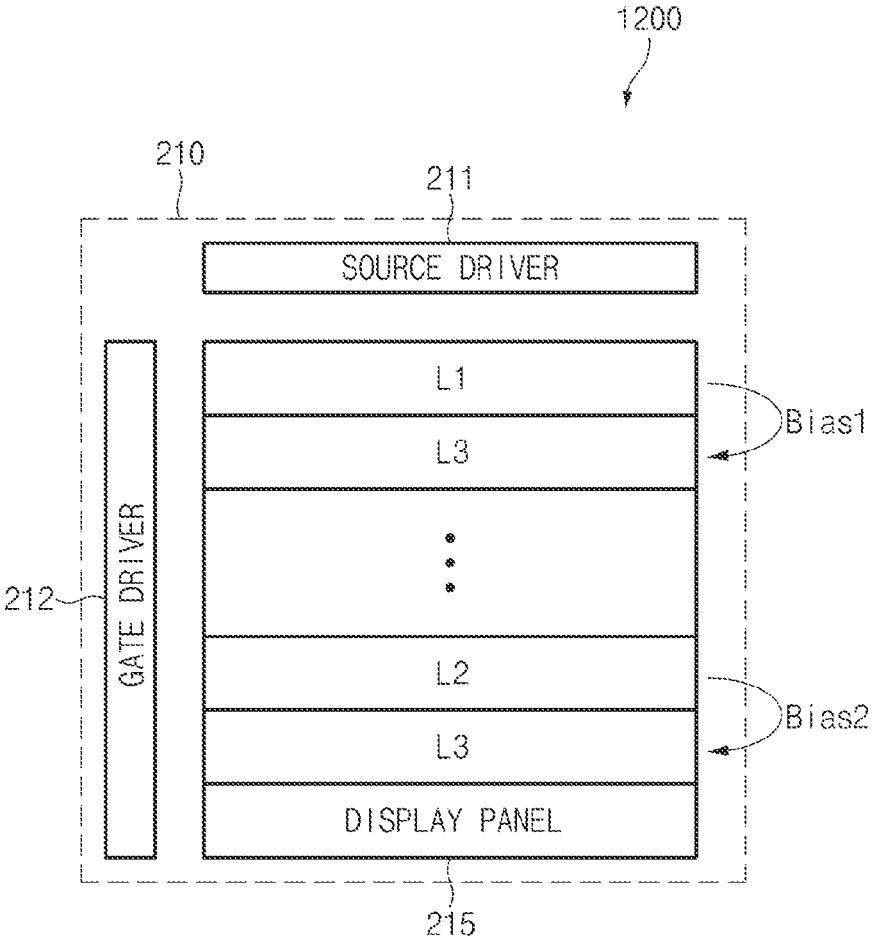
FIG. 13 is a block diagram illustrating source bias currents according to a luminance difference of an image displayed by a display of an electronic device in detail according to another embodiment.

FIG. 13 is a block diagram illustrating source bias currents Bias1 and Bias2 according to a luminance difference of an image displayed by the display 210 of an electronic device 1200 in detail according to another embodiment.

According to an embodiment, the gate driver 212 of the display 210 may transmit a scan signal to the scan line of the display panel 215. The display panel 215 may have a plurality of display regions divided in a direction parallel to the scan line. For example, the display panel 215 may have the plurality of display regions divided in units of scan lines. The plurality of display regions may have different luminances from one another, respectively. For example, the two adjacent display regions disposed on the upper portion among the plurality of display regions may have the first luminance L1 and the third luminance L3, respectively. The third luminance L3 may be lower than the first luminance L1. For a other example, the two adjacent display regions disposed on the lower portion among the plurality of display regions may have the second luminance L2 and the third luminance L3, respectively. The second luminance L2 may be lower than the first luminance L1 and higher than the third luminance L3.

According to an embodiment, the source driver 211 may supply a source voltage corresponding to the luminance difference between adjacent display regions. To generate a source voltage corresponding to the luminance difference between adjacent display regions, the source driver 211 may supply the source voltage generated based on different source bias currents Bias1 and Bias2 to each of the plurality of display regions. For example, the source voltage generated based on the first source bias current Bias1 may be supplied to two display regions, which have the first luminance L1 and the third luminance L3, respectively, from among the plurality of display regions. For another example, the source voltage generated based on the second source bias current Bias2 may be supplied to two display regions, which have the second luminance L2 and the third luminance L3, respectively, from among the plurality of display regions. The second source bias current Bias2 may be smaller than the first source bias current Bias1. Accordingly, when a luminance difference between adjacent display regions is great, the source voltage may be increased during the specified period within 1 frame by increasing the slew rate of the source voltage by using a large source bias current. Moreover, when the luminance difference between adjacent display regions is small, the power consumption of the source driver 211 may be reduced by decreasing the slew rate of the source voltage by using a small source bias current.

Figure 14:
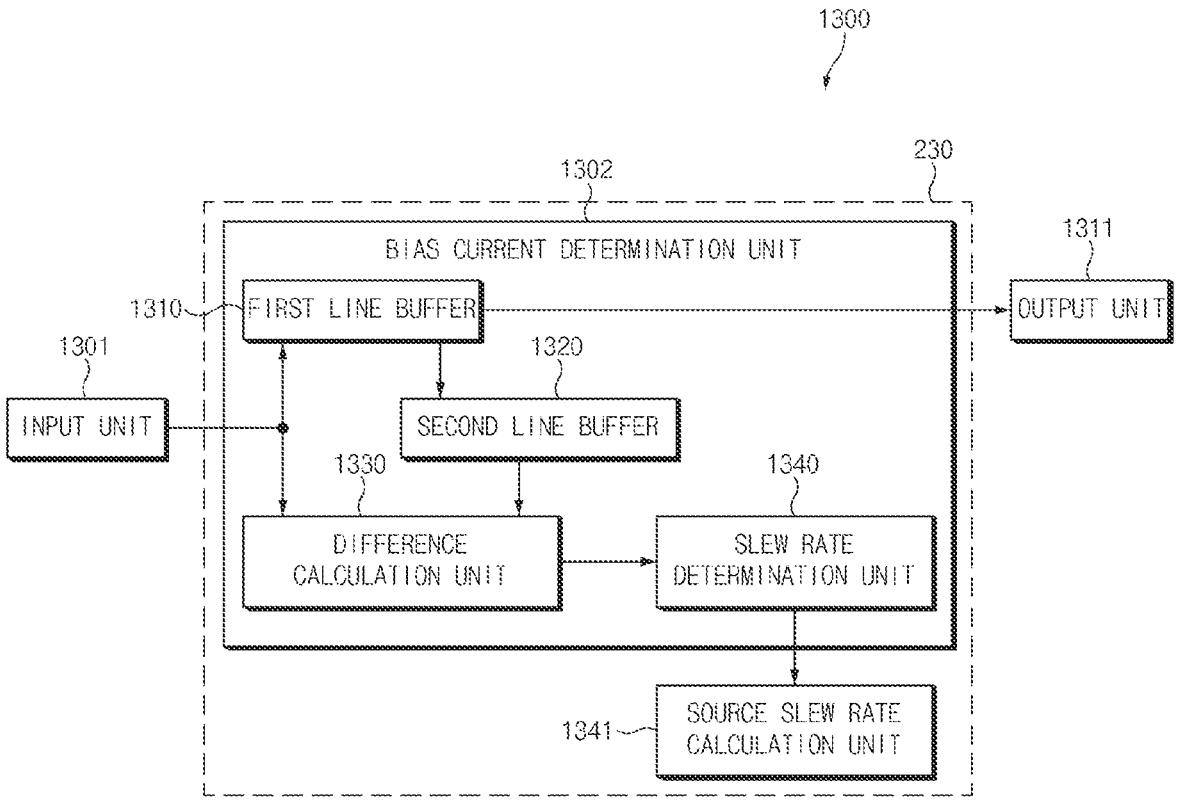
FIG. 14 is a block diagram illustrating a DDI of an electronic device in detail according to another embodiment.

FIG. 14 is a block diagram illustrating the DDI 230 of an electronic device 1300 in detail according to another embodiment. The DDI 230 may include a bias current determination unit 1302 and a source slew rate calculation unit 1341.

According to an embodiment, the bias current determination unit 1302 may set a magnitude of a source bias current for determining a slew rate of a source voltage depending on a luminance of an image displayed by a display panel (e.g., the display panel 215 of FIG. 3). The bias current determination unit 1302 may receive a current luminance value of the image displayed by the display panel 215 from an input unit 1301 for each scan line. The bias current determination unit 1302 may output the current luminance value of the image to an output unit 1311 for each scan line. The bias current determination unit 1302 may include a first line buffer 1310, a second line buffer 1320, a difference calculation unit 1330, and a slew rate determination unit 1340.

According to an embodiment, the first line buffer 1310 may receive a luminance value of the image displayed by the display panel 215 in units of one frame. The first line buffer 1310 may deliver the luminance value of the current frame of the image to the output unit 1311. The first line buffer 1310 may deliver the luminance value of the current frame to the second line buffer 1320 at a point in time when the current frame of the image ends and the next frame starts.

According to an embodiment, the second line buffer 1320 may receive the luminance value of the previous frame of the image displayed by the display panel 215 in units of one frame. The second line buffer 1320 may deliver the luminance value of the previous frame to the difference calculation unit 1330.

According to an embodiment, the difference calculation unit 1330 may receive the luminance value of the current frame of the image from the first line buffer 1310 in units of one frame and may receive the luminance value of the previous frame of the image from the second line buffer 1320 in units of one frame. The difference calculation unit 1330 may calculate a difference value between the luminance value of the current frame and the luminance value of the previous frame.

According to an embodiment, the slew rate determination unit 1340 may receive the difference value between the luminance value of the current frame and the luminance value of the previous frame, from the difference calculation unit 1330. The slew rate determination unit 1340 may set a minimum value and a maximum value of the source voltage generated by the source driver (e.g., the source driver 211 of FIG. 3) based on the difference value. The slew rate determination unit 1340 may generate a source bias current for determining a slew rate of the source voltage.

According to an embodiment, the source slew rate calculation unit 1341 may receive a source bias current from the bias current determination unit 1302. The source slew rate calculation unit 1341 may calculate the change amount and the slew rate of the source voltage according to the source bias current.

According to an embodiment, the source bias current corresponding to the difference value between the luminance value of the current frame and the luminance value of the previous frame may be calculated for each scan line. As such, the slew rate of the source voltage may be controlled by controlling the source bias current even when the luminance values are different for each scan line. Therefore, the length of the period in which the source voltage increases from the minimum value to the maximum value may be identically controlled. Furthermore, when the difference value between the minimum and maximum values of the source voltage is not greater than the specified value, the power consumed by the source driver 211 may be reduced by decreasing the magnitude of the source bias current.

Figure 15:
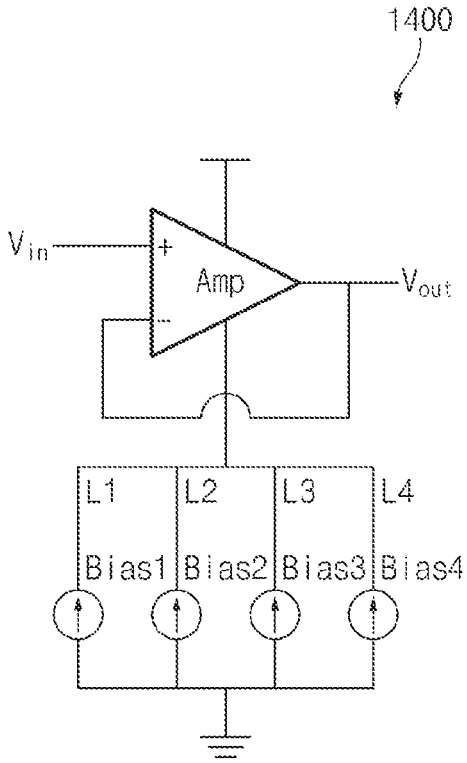
FIG. 15 is a diagram illustrating a source driver of an electronic device according to still another embodiment.

FIG. 15 is a diagram illustrating a source driver 1400 of the electronic device 101 according to still another embodiment. The source driver 1400 may include an amplifier circuit Amp and one or more current sources that generate a plurality of source bias currents Bias1 to Bias4.

According to an embodiment, the amplifier circuit Amp may receive an input voltage Vin and may generate an output voltage Vout. The output voltage Vout of the amplifier circuit Amp of the source driver 1400 may be referred to as a source voltage supplied to the display panel (e.g., the display panel 215 of FIG. 3). The amplifier circuit Amp may be connected to one or more current sources.

According to an embodiment, the one or more current sources may generate the plurality of source bias currents Bias1 to Bias4. The one or more current sources may supply a source bias current having a specified magnitude to the amplifier circuit Amp, depending on the slew rate of the source voltage supplied to the display panel 215 among the plurality of source bias currents Bias1 to Bias4.

According to an embodiment, the one or more current sources may control the magnitude of the source bias current supplied to the amplifier circuit Amp depending on the luminances L1 to L4. For example, the one or more current sources may supply the first source bias current Bias1 to the amplifier circuit Amp at the first luminance L1. The one or more current sources may supply the second source bias current Bias2 to the amplifier circuit Amp at the second luminance L2. The one or more current sources may supply the third source bias current Bias3 to the amplifier circuit Amp at the third luminance L3. The one or more current sources may supply the fourth source bias current Bias4 to the amplifier circuit Amp at the fourth luminance L4. Accordingly, the time required to increase the source voltage may be identically controlled regardless of the difference value between the minimum value and the maximum value of the source voltage according to a luminance. Moreover, when the difference value between the minimum and maximum values of the source voltage is not greater than a specified value, the power consumed by the source driver 1400 may be reduced by reducing the source bias current.

According to various embodiments, an electronic device (e.g., the electronic device 101 of FIG. 1) may include a display panel (e.g., the display panel 215 of FIG. 3) for displaying an image, a source driver (e.g., the source driver 211 of FIG. 3) for supplying a source voltage to the display panel 215, and a DDI (e.g., the DDI 230 of FIG. 2) including a timing controller (e.g., the timing controller 360 of FIG. 3) controlling the source driver, and a processor (e.g., the processor 120 of FIG. 1) delivering an image control signal to the DDI 230. The timing controller 360 may set a source bias current for controlling a slew rate of the source voltage depending on the luminance of the image.

According to an embodiment, when the luminance of the image is decreased depending on a command included in the image control signal, the processor may decrease a value of the source bias current.

According to an embodiment, the DDI 230 may receive a command for setting the luminance of the image from the processor 120 in units of frames and may set a minimum value of the source voltage in response to the luminance set depending on the command.

According to an embodiment, the source driver 211 may include an amplifier circuit (e.g., the amplifier circuit 421 of FIG. 5) receiving an input voltage and generating the source voltage as an output voltage and a boosting circuit (e.g., the boosting circuit 422 of FIG. 5) connected to the amplifier circuit 421 and at least temporarily changing the output voltage by controlling the input voltage.

According to an embodiment, when the image has a first luminance, the source voltage may have a first slew rate. When the image has a second luminance lower than the first luminance, the source voltage may have a second slew rate lower than the first slew rate.

According to an embodiment, when the image has a first luminance, the source voltage may be changed from a first voltage to a second voltage during a first period. When the image has a second luminance lower than the first luminance, the source voltage may be changed from a third voltage higher than the first voltage to a second voltage during the first period.

According to an embodiment, the source driver 211 may include an amplifier circuit (e.g., the amplifier circuit 1024 of FIG. 11) receiving an input voltage and generating the source voltage as an output voltage and a plurality of boosting circuits (e.g., the first to third boosting circuits 1021 to 1023 of FIG. 11) connected to the amplifier circuit 1024 and at least temporarily changing the output voltage by controlling the input voltage. The source driver may select one boosting circuit among the plurality of boosting circuits to supply the source bias current to the amplifier circuit.

According to an embodiment, an electronic device may further include one or more current sources supplying the source bias current. The one or more current sources may control the slew rate of the source voltage by controlling a magnitude of the source bias current.

According to an embodiment, the source voltage may increase from a minimum value to a maximum value during an identical time (e.g., the slew period SP) regardless of the luminance of the image.

According to various embodiments, an electronic device 101 may include a display panel 215 displaying an image, a source driver 211 supplying a source voltage to the display panel 215, a DDI 230 including a timing controller 360 controlling the source driver 211, and a processor 120 delivering an image control signal to the DDI 230. The source driver 211 may set a minimum value of the source voltage and a maximum value of the source voltage in units of frames and may adjust a slew rate of the source voltage depending on the minimum value of the source voltage and the maximum value of the source voltage.

According to an embodiment, the timing controller 360 may decrease the minimum value of the source voltage and may increase a slew rate of the source voltage, when a luminance of the image is decreased.

According to an embodiment, the source driver 211 may uniformly maintain a period from the minimum value of the source voltage to the maximum value of the source voltage regardless of a minimum value of the source voltage and a maximum value of the source voltage.

According to an embodiment, the source driver 211 may generate a source bias current controlling a slew rate of the source voltage. A magnitude of the source bias current may increase as the minimum value of the source voltage decreases.

According to an embodiment, the source driver 211 may increase the luminance of the image after increasing the source bias current.

According to an embodiment, the DDI 230 may turn off a fast slew function using a boosting circuit of the source driver when a change amount of the source voltage is reduced to a specified amount or less.

According to various embodiments, an electronic device 101 may include a display panel 215 displaying an image, a source driver 211 supplying a source voltage to the display panel 215, a DDI 230 including a timing controller 360 controlling the source driver 211, and a processor 120 delivering an image control signal to the DDI 230. The timing controller 360 may change a source bias current controlling a slew rate of the source voltage in units of frames depending on the luminance of the image.

Figure 16:
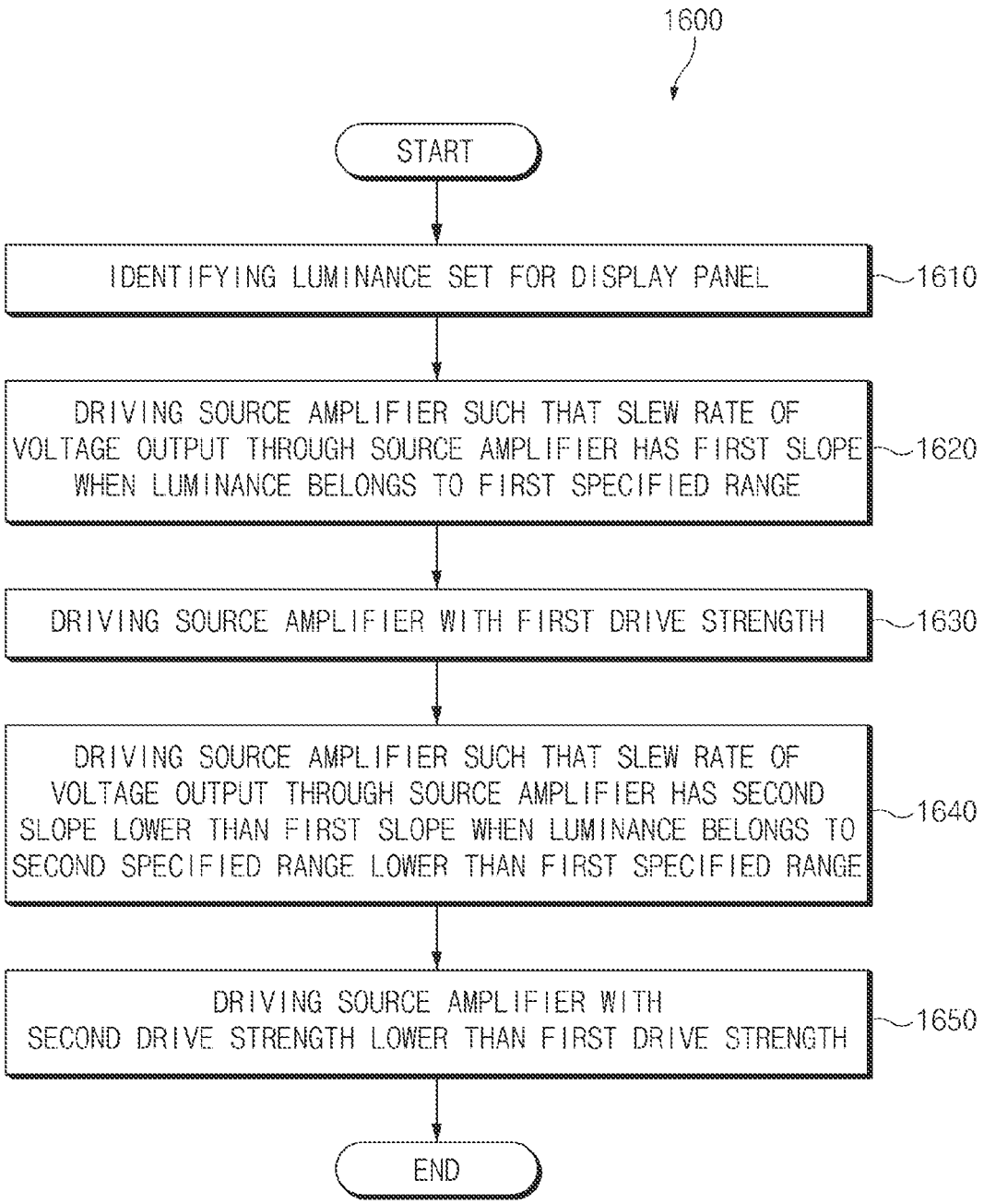
FIG. 16 is a flowchart illustrating an operation, in which a DDI controls a slew rate of a voltage outputted through a source amplifier, according to an embodiment.

FIG. 16 is a flowchart illustrating an operation, in which a DDI (e.g., the DDI 300 of FIG. 3) controls a slew rate of a voltage outputted through a source amplifier (e.g., the source driver 211 of FIG. 11), according to an embodiment. According to various embodiments, an electronic device (e.g., the electronic device 101 in FIG. 1) may include a display panel (e.g., the display panel 215 of FIG. 3) including one or more pixels, a source port (e.g., a port connecting between the source driver 211 and the DDI 300 in FIG. 3) electrically connected to at least part of the one or more pixels, and a source amplifier (e.g., the amplifier circuit 1024 included in the source voltage generation unit 1020 of FIG. 11) electrically connected to the source port.

According to an embodiment, in operation 1610, the electronic device 101 may identify the luminance set for the display panel 215. To identify the luminance set for the display panel 215, the electronic device 101 may identify information associated with an operating mode of the display panel 215. The electronic device 101 may identify information associated with the operating mode of the display panel 215 and may identify the operating mode based on the information associated with the operating mode.

According to an embodiment, the electronic device 101 may further include at least one processor (e.g., the processor 120 of FIG. 3) operationally connected to the DDI 300. For example, the DDI 300 may receive and identify the information associated with the operating mode of the display panel 215 from the at least one processor 120. For another example, the DDI 300 may identify the information associated with the operating mode of the display panel 215 by outputting the image data (e.g., VIDEO of FIG. 3) received from the at least one processor 120 to the display panel 215 and identifying the output image data VIDEO.

According to an embodiment, when a luminance belongs to the first specified range, in operation 1620, the electronic device 101 may drive the source amplifier 1024 such that the slew rate of the voltage (e.g., the source voltage Vout) output through the source amplifier 1024 has a first slope. For example, when driving at least part of the display panel 215 at the first luminance L1, the electronic device 101 may control the source amplifier so as to output the specified output voltage in the first time range.

According to an embodiment, in operation 1630, the electronic device 101 may drive the source amplifier 1024 with a first drive strength. The drive strength may be the size of a current capacity capable of being output from the output terminal (e.g., the output terminal of OP-Amp) of the source amplifier 1024. The drive strength may be the size of a current capacity capable of being driven by the source amplifier 1024 (e.g., capable of being driven to the output terminal of the source amplifier 1024 by using the boosting circuits 1021 to 1023 of FIG. 11).

According to an embodiment, when the luminance belongs to the second specified range lower than the first specified range, in operation 1640, the electronic device 101 may drive the source amplifier 1024 such that the slew rate of the voltage output through the source amplifier 1024 has a second slope lower than the first slope. For example, when driving at least part of the display panel 215 at the second luminance L2 lower than the first luminance L1, the electronic device 101 may control the source amplifier 1024 so as to output a specified output voltage in a second time range longer than the first time range.

According to an embodiment, the electronic device 101 may further include the plurality of boosting circuits 1021 to 1023, which are connected to the source amplifier 1024 and which at least temporarily change the specified output voltage by at least temporarily changing the current input to the source amplifier 1024. The electronic device 101 may select one of the plurality of boosting circuits 1021 to 1023 to control the intensity of a specified output voltage output by the source amplifier 1024.

According to an embodiment, when driving the remaining parts of the display panel 215 at the third luminance L3, the DDI 300 may control the source amplifier so as to output a specified output voltage in the third time range.

According to an embodiment, in operation 1650, the electronic device 101 may drive the source amplifier 1024 with a second drive strength lower than the first drive strength. The electronic device 101 may further include the plurality of boosting circuits 1021 to 1023, which are connected to the source amplifier 1024 and which at least temporarily change a current input to the source amplifier 1024. The electronic device 101 may select one of the plurality of boosting circuits 1021 to 1023 to set the source amplifier 1024 to be driven with the first drive strength or the second drive strength.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases. As used herein, such terms as "1st" and "2nd", or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with", "coupled to", "connected with", or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic", "logic block", "part", or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

What is claimed is:

1. An electronic device comprising:

a display panel configured to display an image;

a source driver configured to supply a source voltage to the display panel;

a display driver integrated circuit (DDI) including a timing controller configured to control the source driver; and a processor operationally connected to the DDI, wherein the DDI is configured to:

receive image information that contains image data from the processor to display the image; and receive an image control signal for controlling the image data from the processor to control a luminance of the image, and, wherein the timing controller is configured to:

identify the luminance of the image from the image information; and set a source bias current for controlling a slew rate of the source voltage based on the luminance of the image, wherein the source voltage has a first slew rate when the image has a first luminance, and wherein the source voltage has a second slew rate lower than the first slew rate when the image has a second luminance lower than the first luminance.

2. The electronic device of claim 1, wherein the processor is configured to:

transmit the image information and the image control signal to the DDI; and decrease a value of the source bias current when the luminance of the image is decreased.

3. The electronic device of claim 2, wherein the DDI is configured to obtain a command including the information associated with the luminance of the image from the processor in units of frames and set a minimum value of the source voltage based on the image information.

4. The electronic device of claim 1, wherein the source driver includes:

an amplifier circuit configured to receive an input voltage and to generate the source voltage as an output voltage; and a boosting circuit for boosting the source bias current and having an on/off state determined in accordance with the luminance of the image.

5. The electronic device of claim 1, further comprising:

one or more current sources configured to supply the source bias current.

6. The electronic device of claim 1, wherein the source voltage is controlled to increase from a minimum value to a maximum value during an identical time regardless of the luminance of the image.

7. The electronic device of claim 1, wherein the source voltage is changed from a first voltage to a second voltage during a first period when the image has a first luminance, and wherein the source voltage is changed from a third voltage higher than the first voltage to the second voltage during the first period when the image has a second luminance lower than the first luminance.

8. The electronic device of claim 1, wherein the image information comprises illumination sensor information.

9. An electronic device comprising:

a display panel configured to display an image;

a source driver configured to supply a source voltage to the display panel; and a display driver integrated circuit (DDI) including a timing controller configured to control the source driver, wherein the timing controller is configured to:

identify information associated with a luminance of the image; and set a source bias current for controlling a slew rate of the source voltage based on the luminance of the image, and wherein the source voltage is changed from a first voltage to a second voltage during a first period when the image has a first luminance, and wherein the source voltage is changed from a third voltage higher than the first voltage to the second voltage during the first period when the image has a second luminance lower than the first luminance.

10. An electronic device comprising:

a display panel including one or more pixels;

a source port electrically connected to at least part of the one or more pixels; and a display driver integrated circuit (DDI) including a source amplifier electrically connected the source port, wherein the DDI is configured to:

identify a luminance set for the display panel;

drive the source amplifier such that a slew rate of a voltage output through the source amplifier has a first slope, when the luminance is in a first specified range; and drive the source amplifier such that the slew rate of the voltage output through the source amplifier has a second slope lower than the first slope when the luminance is in a second specified range lower than the first specified range.

11. The electronic device of claim 10, further comprising:

at least one processor operationally connected to the DDI, wherein the DDI is configured to receive and identify information associated with an operating mode of the display panel from the at least one processor.

12. The electronic device of claim 10, further comprising:

at least one processor operationally connected to the DDI, wherein the DDI is configured to identify information associated with an operating mode of the display panel by outputting image data received from the at least one processor to the display panel and identifying the output image data.

13. The electronic device of claim 10, wherein the DDI is configured to control the source amplifier to output a specified output voltage in a first time period when driving at least part of the display panel at a first luminance and control the source amplifier to output the specified output voltage in a second time period longer than the first time period when driving at least part of the display panel at a second luminance lower than the first luminance.

14. The electronic device of claim 13, further comprising:

a plurality of boosting circuits connected to the source amplifier and configured to at least temporarily change the specified output voltage by at least temporarily changing a current input to the source amplifier, wherein the DDI is configured to select one boosting circuit among the plurality of boosting circuits to control an intensity of the specified output voltage output by the source amplifier.

15. The electronic device of claim 13, wherein the DDI is configured to control the source amplifier to output the specified output voltage in a third time period when driving the remaining parts of the display panel at a third luminance.

* * * * *